US010128608B2

(12) United States Patent
Kasar et al.

(10) Patent No.: US 10,128,608 B2
(45) Date of Patent: Nov. 13, 2018

(54) SEALED ELECTRONIC CONNECTORS FOR ELECTRONIC DEVICES

(71) Applicant: APPLE INC., Cupertino, CA (US)

(72) Inventors: Darshan R. Kasar, San Francisco, CA (US); Craig M. Stanley, Campbell, CA (US); David B. Flamholz, Teaneck, NJ (US); Phillip Qian, San Jose, CA (US); Matthew E. Lang, Santa Clara, CA (US); Ferdinand S. Toting, Daly City, CA (US); Eric S. Jol, San Jose, CA (US); Trent K. Do, San Jose, CA (US); Joel C. Yamasaki, San Francisco, CA (US); Hani Esmaeili, Sunnyvale, CA (US); Nathan A. Van Nortwick, Santa Clara, CA (US); Richard J. Blanco, San Francisco, CA (US); Jonathan C. Lorman, San Jose, CA (US); Daniel Wagman, Scotts Valley, CA (US); Edward S. Huo, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/471,697

(22) Filed: Mar. 28, 2017

(65) Prior Publication Data

US 2018/0069342 A1 Mar. 8, 2018

Related U.S. Application Data

(60) Provisional application No. 62/384,112, filed on Sep. 6, 2016, provisional application No. 62/398,377, filed
(Continued)

(51) Int. Cl.
*H01R 13/52* (2006.01)
*H01R 24/62* (2011.01)
(Continued)

(52) U.S. Cl.
CPC ..... *H01R 13/5219* (2013.01); *H01R 13/521* (2013.01); *H01R 13/5227* (2013.01);
(Continued)

(58) Field of Classification Search
CPC ..... H01R 13/5219
See application file for complete search history.

(56) References Cited

U.S. PATENT DOCUMENTS 4,810,205 A * 3/1989 O'Grady ..... H01R 13/506 439/350
7,214,075 B2 5/2007 He et al.
(Continued)

FOREIGN PATENT DOCUMENTS

JP 2011141977 A 7/2011
WO 2018048721 A1 3/2018

OTHER PUBLICATIONS

Invitation to Pay Add'l Fees and Partial Search Report in PCT Application No. PCT/US2017/049649, dated Nov. 20, 2017 in 16 pages.
International Search Report and Written Opinion in PCT Application No. PCT/US2017/049649, dated Jan. 12, 2018 in 19 pages.

*Primary Examiner* — James Harvey
(74) *Attorney, Agent, or Firm* — Kilpatrick Townsend and Stockton, LLP

(57) ABSTRACT

A plug connector for an electronic device has a deformable seal positioned on it such that when the plug connector is mated to the electronic device a liquid-tight seal is formed between the plug connector and the electronic device. A seal may also be positioned within a receptacle connector cavity of the electronic device such that it forms a liquid-tight seal to a plug connector when the plug connector is mated to the electronic device.

14 Claims, 16 Drawing Sheets

Related U.S. Application Data on Sep. 22, 2016, provisional application No. 62/398,383, filed on Sep. 22, 2016.

(51) Int. Cl.

| | |
|---|---|
| ***H01R 13/631*** | (2006.01) |
| ***H01R 13/66*** | (2006.01) |
| ***H01R 13/717*** | (2006.01) |
| ***H01R 24/28*** | (2011.01) |
| ***H01R 24/76*** | (2011.01) |
| ***H01R 24/00*** | (2011.01) |
| ***H01R 24/60*** | (2011.01) |
| *H01R 107/00* | (2006.01) |

(52) U.S. Cl.

CPC ..... *H01R 13/631* (2013.01); *H01R 13/6683* (2013.01); *H01R 13/6691* (2013.01); *H01R 13/717* (2013.01); *H01R 24/00* (2013.01); *H01R 24/28* (2013.01); *H01R 24/60* (2013.01); *H01R 24/62* (2013.01); *H01R 24/76* (2013.01); *H01R 2107/00* (2013.01)

(56) References Cited

U.S. PATENT DOCUMENTS

| | | | | |
|---|---|---|---|---|
| 7,652,892 | B2 * | 1/2010 | Shiu | H05K 3/284 174/521 |
| 7,922,535 | B1 * | 4/2011 | Jiang | H01R 13/5205 439/271 |
| 8,647,150 | B2 * | 2/2014 | Fujiwara | H01R 13/5221 439/587 |
| 9,825,398 | B1 * | 11/2017 | Uchida | H01R 13/5219 |
| 9,899,779 | B1 * | 2/2018 | Lin | H01R 24/60 |
| 2004/0229506 | A1 | 11/2004 | Asao et al. | |
| 2013/0115821 | A1 * | 5/2013 | Golko | H01R 13/516 439/638 |
| 2013/0183845 | A1 * | 7/2013 | Tan | H01R 13/5202 439/271 |
| 2014/0295689 | A1 * | 10/2014 | Zhao | H01R 12/724 439/271 |
| 2018/0019544 | A1 * | 1/2018 | Ishibashi | H01R 13/6315 |
| 2018/0069342 | A1 * | 3/2018 | Kasar | H01R 13/5219 |

* cited by examiner

SEALED ELECTRONIC CONNECTORS FOR ELECTRONIC DEVICES

CROSS-REFERENCES TO OTHER APPLICATIONS

This application claims priority to U.S. provisional patent application Ser. No. 62/384,112, for "SEALED ELECTRONIC CONNECTORS FOR ELECTRONIC DEVICES" filed on Sep. 6, 2016, to U.S. provisional patent application Ser. No. 62/398,377, for "VACUUM SEALED CONNECTOR FOR ELECTRONIC DEVICES" filed on Sep. 22, 2016, to U.S. provisional patent application Ser. No. 62/398,383, for "SEALED ACCESSORIES FOR ELECTRONIC DEVICES" filed on Sep. 22, 2016, each of which is hereby incorporated by reference in its entirety for all purposes.

This application is related to the following concurrently filed and commonly assigned U.S. nonprovisional patent applications:

U.S. nonprovisional patent application Ser. No. 15/471,936, Filed Mar. 28, 2017, "VACUUM SEALED CONNECTOR FOR ELECTRONIC DEVICES; U.S. nonprovisional patent application Ser. No. 15/472,096, Filed Mar. 28, 2017, "SEALED ACCESSORIES FOR ELECTRONIC DEVICES"; each of which is hereby incorporated by reference in its entirety for all purposes.

FIELD

The described embodiments relate generally to electronic connectors and accessories that are used with electronic devices. More particularly, the present embodiments relate to electronic connectors and accessories that provide methods of sealing the connectors, accessories and the electronic device against liquid or debris ingression.

BACKGROUND

Currently there are a wide variety of electronic devices available for consumers today that employ a broad range of external electronic connectors to facilitate communication with other devices and/or charging of the electronic device. As an example, audio jack, data and power connectors are sometimes positioned on one or more external surfaces of an electronic device. As electronic devices become more indispensable to their operators they are used in increasingly harsh environments and are likely to be exposed to moisture or debris that may result in liquid or debris ingression into the connectors and/or the electronic device. This may result in damage within the connector and possibly damage to circuitry within the electronic device. Protection of the electronic device and/or accessories from such environmental damage can enable new applications for the electronic device and/or accessories.

SUMMARY

Some embodiments of the invention pertain to electrical connectors that have one or more gaskets or seals configured to impede moisture from penetrating the connector and/or electronic devices. Various embodiments relate to a seal positioned on the connector plug and/or within an electronic device such that a liquid-tight seal is formed when the connector plug is mated with the electronic device.

In some embodiments a plug connector comprises a body and an outer shell encasing at least a portion of the body. A connector tab extends away from the body beyond the outer shell; and a seal is positioned at least partially between the outer shell and the connector tab. The seal fully surrounds a cross-sectional portion of the connector tab at a location where the connector tab extends out of the body. In various embodiments the connector tab forms a portion of an axisymmetric connector that can be mated with a receptacle connector in a first orientation and a second orientation, wherein the second orientation is rotated 180 degrees along an axis of symmetry from the first orientation.

In some embodiments the connector tab includes a first surface having a plurality of external contacts and a second surface opposite the first surface. In various embodiments the plug connector further comprises one or more retention features that secure the plug connector to a corresponding receptacle connector in a mated position. In some embodiments the seal is positioned to form a liquid-tight seal to an enclosure of an electronic device when the plug connector is mated to a receptacle connector of the electronic device.

In some embodiments the seal is formed from a silicone material. In various embodiments the seal extends away from the first face a distance between 0.25 and 2 millimeters.

In some embodiments a plug connector comprises a body having a first face and a connector tab extending from a base portion positioned at the first face to a distal end, the connector tab including a first surface having a plurality of contacts and a second surface opposite the first surface. A deformable seal is positioned around a perimeter of the base portion of the connector tab. In various embodiments the deformable seal is in direct contact with both the body and the connector tab.

In some embodiments the body has an outer shell encasing at least a portion of the body and the deformable seal is positioned at least partially between the outer shell and the connector tab. In various embodiments the deformable seal is disposed across a majority of the first face.

In some embodiments the deformable seal is secured to the body with an adhesive. In various embodiments the deformable seal is formed from an elastomeric material having a hardness in a range between 5 and 80 Shore A. In some embodiments the deformable seal extends away from the first face a distance between 0.25 and 2 millimeters.

In some embodiments an electronic device comprises an exterior housing having a receiving opening and a receptacle connector positioned within the exterior housing and having a cavity that communicates with the receiving opening, wherein there are a plurality of electrical contacts disposed within the cavity and positioned to make contact with a corresponding plug connector. A deformable peripheral seal is positioned between the receiving opening and the plurality of electrical contacts and the deformable peripheral seal has an aperture aligned with the receiving opening wherein the aperture is smaller than the receiving opening.

In some embodiments a portion of the deformable peripheral seal is disposed between the exterior housing and the receptacle connector. In various embodiments the deformable peripheral seal is integrated within the receptacle connector. In some embodiments a tab portion of the corresponding plug connector is receivable within the cavity and the deformable peripheral seal has an aperture that is smaller than the tab portion such that a liquid-tight seal is formed between the tab portion and the electronic device when the corresponding plug connector is mated with the receptacle connector.

In some embodiments the exterior housing includes a trim ring and wherein the receiving opening is formed into the trim ring. In various embodiments a portion of the deformable peripheral seal is positioned between the trim ring and the receptacle connector.

In some embodiments an accessory for an electronic device comprises an exterior housing having a first face, and a plug connector configured to be received by a receptacle connector of the electronic device. The receptacle connector comprises a connector tab extending away from the first face and a seal positioned around the connector tab and against the first face where the seal fully surrounds a cross-sectional portion of the connector tab at a region where the connector tab extends out of the housing.

In various embodiments the connector tab includes an opening at an exterior surface of the connector tab and the accessory further comprises a vacuum generator fluidly coupled to the opening. In some embodiments the vacuum generator is operated by deflecting a portion of the exterior housing. In various embodiments the vacuum generator comprises a resilient deflectable portion of the housing that forms at least a portion of a cavity such that depressing the resilient deflectable portion causes an increase in air pressure at the port and subsequently releasing the deflectable portion to return to its original shape causes a decrease in air pressure at the port.

In some embodiments the accessory further comprises an electric motor operatively coupled to the vacuum generator. In various embodiments the vacuum pump comprises a piston-type vacuum pump. In some embodiments the vacuum pump comprises a diaphragm-type vacuum pump.

In some embodiments the motor can be activated to provide an alert to a user without operating the vacuum pump. In various embodiments the accessory further comprises a user activated switch that can control whether the motor functions as a vibration device without activating the vacuum generator or functions as a vacuum pump. In some embodiments the vacuum generator comprises speaker that functions as both a speaker and a vacuum pump diaphragm.

In some embodiments the accessory further comprises an air pressure sensor that is pneumatically coupled to the port. In various embodiments the accessory further comprises a vacuum release valve that is operable by a user to break a vacuum seal between the electronic device and the module. In some embodiments the connector tab includes a vent port that mates to an exhaust port within a receptacle connector of the electronic device, and the vent port is coupled to an aperture in the exterior housing of the accessory.

In some embodiments the accessory further comprises a light source that emits light outside of the exterior housing. In various embodiments the light source is controlled and powered by the electronic device when the plug connector is received by the receptacle connector of electronic device. In some embodiments the accessory further comprises a sensor for detecting one or more parameters of a liquid and the sensor communicates with the electronic device through the plug connector.

In some embodiments the accessory further comprises a second connector that connects to a module and forms a liquid-tight seal to the module. In various embodiments the accessory further comprises a speaker secured to the housing and configured to emit sound outside of the housing. In some embodiments the accessory further comprises a camera that can capture images outside of the accessory.

In some embodiments an accessory for an electronic device comprises an exterior housing and an axisymmetric connector tab electrically coupled to the accessory and extending from a base portion to a distal end. The connector tab includes a first surface having a plurality of contacts and a second surface opposite the first surface. A deformable seal is positioned around a perimeter of the base portion of the connector tab.

In some embodiments a portable electronic device comprises an exterior housing having a receiving opening and a receptacle connector positioned within the exterior housing and having a cavity that communicates with the receiving opening. A vacuum generator is fluidly coupled to the cavity by a vacuum line that extends between the cavity and the vacuum generator.

In some embodiments the vacuum generator is operated by deflecting a portion of the exterior housing. In various embodiments the vacuum generator comprises a resilient deflectable portion of the housing that forms at least one wall of a cavity such that depressing the resilient deflectable portion causes an increase in air pressure at the port and subsequently releasing the deflectable portion to return to its original shape causes a decrease in air pressure at the port. In various embodiments the vacuum generator is operated by an electric motor.

In some embodiments the electric motor operates a piston-type vacuum pump. In various embodiments the electric motor operates a diaphragm-type vacuum pump. In some embodiments the motor also functions as a vibration device. In various embodiments the motor functions as a vibration device when operated in a first direction and functions as a vibration device and a vacuum pump when operated in an opposite direction.

In some embodiments the vacuum generator comprises speaker that functions as both a speaker and a vacuum pump diaphragm. In some embodiments the portable electronic further comprises an air pressure sensor that is pneumatically coupled to the port. In some embodiments the portable electronic device further comprises a vacuum release valve pneumatically coupled to the port. In various embodiments the receptacle connector includes an exhaust port that is pneumatically coupled to the vacuum generator.

In some embodiments the vacuum generator is engaged by a user operating a user interface input of the electronic device. In various embodiments the user interface inputs include one of: a button, an interactive graphical user interface displayed on a touch sensitive screen and a voice recognition system.

In some embodiments an electronic device comprises an exterior housing, an electrical receptacle connector having a vacuum port, and an electrically operated vacuum generator disposed within the exterior housing and pneumatically coupled to the vacuum port. In various embodiments the electronic device further comprises a touch screen and a processor that executes a software program presenting an icon on the touch screen for a user to operate the vacuum generator.

In various embodiments the receptacle connector includes an exhaust port that is pneumatically coupled to the vacuum generator. In some embodiments the receptacle connector is configured to receive a plug connector of an accessory. The plug connector forms a sealed connection to the exhaust port and allows the transfer of vacuum exhaust from the vacuum generator, through the mated connectors and out of the accessory.

In some embodiments the vacuum generator is an electric motor that functions as a vibration device when operated in a first direction and functions as a vibration device and a vacuum pump when operated in an opposite direction. In various embodiments the electronic device further comprises a vacuum release valve pneumatically coupled to the vacuum port.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Figure 1:
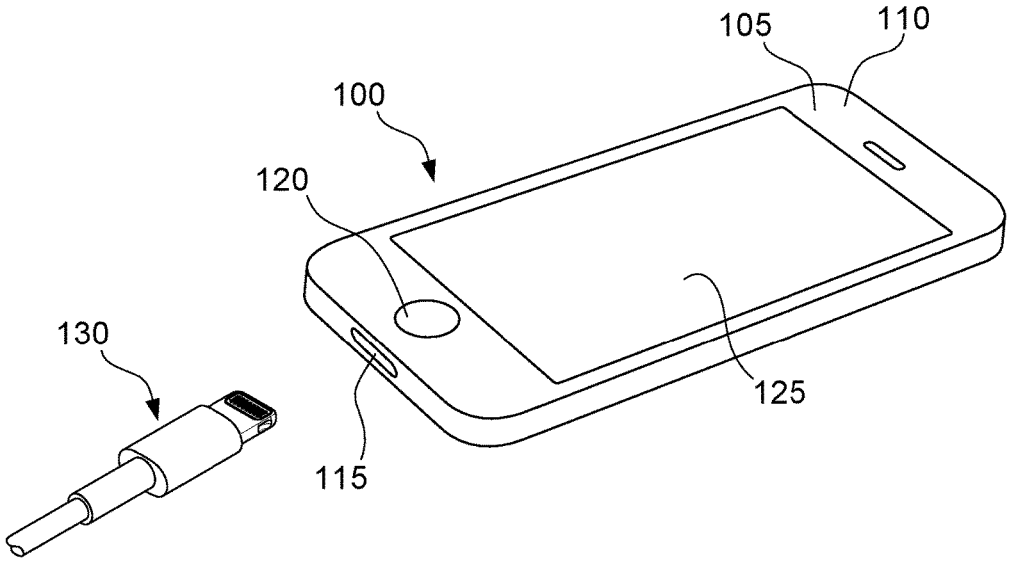
FIG. 1 is a front perspective view of an electronic device and a corresponding plug connector according to an embodiment of the disclosure.

Some embodiments of the present disclosure relate to plug connectors equipped with a seal to prevent liquid from entering a corresponding electronic device when the plug connector is mated with the electronic device. Other embodiments relate to seals that are positioned within an electronic device receptacle connector cavity such that when a plug connector is mated with the electronic device a liquid-tight seal is formed between the plug connector and the electronic device. Further embodiments relate to sealed accessories that mate to an electronic device with sealed connectors. Yet further embodiments relate to vacuum generators that can be disposed within an electronic device or an accessory and used to generate a vacuum seal between mated connectors (e.g., between an electronic device and an accessory). While the present disclosure can be useful for a wide variety of configurations, some embodiments of the disclosure are particularly useful for electronic devices that need to be protected against liquid ingression, as described in more detail below.

For example, in some embodiments a tab portion of a plug connector is configured to be received within a cavity of a receptacle connector of an electronic device. The tab portion of the plug connector has a seal formed around its base such that when the plug connector is mated with the electronic device a liquid-tight seal (as defined in more detail below) is formed between the plug connector and the electronic device.

In another example a receptacle connector of an electronic device is configured to receive a corresponding plug connector. A tab of the plug connector is received through an opening in the exterior housing of the electronic device and into a receptacle containing a plurality of electronic contacts. A peripheral seal is disposed within the receptacle cavity of the electronic device, positioned between the opening and the plurality of contacts such that it forms a liquid-tight seal to the tab of the plug connector.

In another example an accessory has a plug connector with a gasket that seals to an electronic device. The accessory may also be sealed so it and the electronic device can be used in wet or dirty environments, including under water.

In a further example an electronic device or an accessory is equipped with a vacuum pump that is coupled to a mating connector such that when an electronic device is mated to an accessory a vacuum seal can be formed between the mated connectors.

In order to better appreciate the features and aspects of liquid-tight electronic connectors for electronic devices according to the present disclosure, further context for the disclosure is provided in the following section by discussing one particular implementation of sealed connectors in an electronic device according to embodiments of the present disclosure. These embodiments are for example only and other embodiments can be employed in other electronic devices and connector configurations such as, but not limited to computers, watches, media players and other devices.

Seals for Connector Plugs

FIG. 1 depicts an illustrative rendering of an electronic device 100, such as a smart phone, according to some embodiments of the disclosure. In various embodiments electronic device 100 may be a tablet computer, a mobile computing device, a smart phone, a cellular telephone, a digital media player, or a variety of different types of electronic devices. Electronic device 100 includes an exterior housing 105 having an exterior surface 110, a receptacle connector 115, a multipurpose button 120 as an input component, a touch screen display 125 as both an input and output component and more microphones and speakers.

Figure 2:
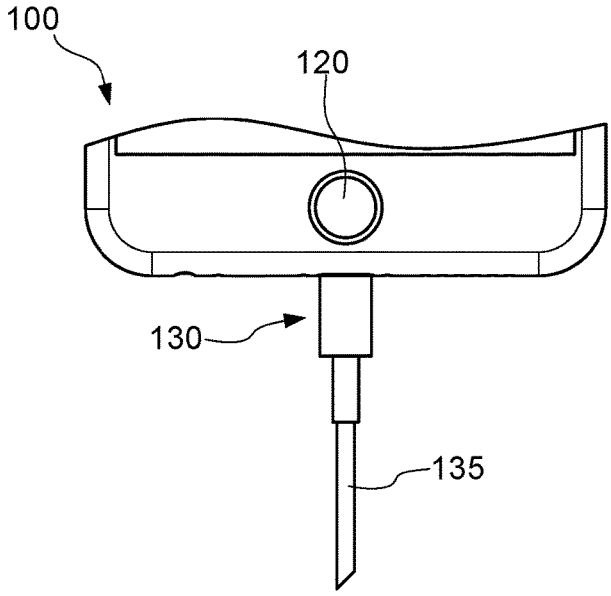
FIG. 2 is a partial view of the electronic device illustrated in FIG. 1 with the corresponding plug connector engaged in a receptacle connector of the electronic device.

Electronic device 100 can be charged and may communicate through receptacle connector 115 that is sized and configured to receive plug connector 130, as shown in a mated position in FIG. 2. In some embodiments receptacle connector 115 and/or plug connector 130 may have one or more gaskets or seals (not shown in FIGS. 1 and 2) that prevent liquid ingression into the receptacle connector and/or electronic device 100, as described in more detail below. In FIGS. 1 and 2, plug connector 130 is illustrated with a data transfer cable 135, however it can be employed in other configurations such as a docking station or accessory.

Figure 3:
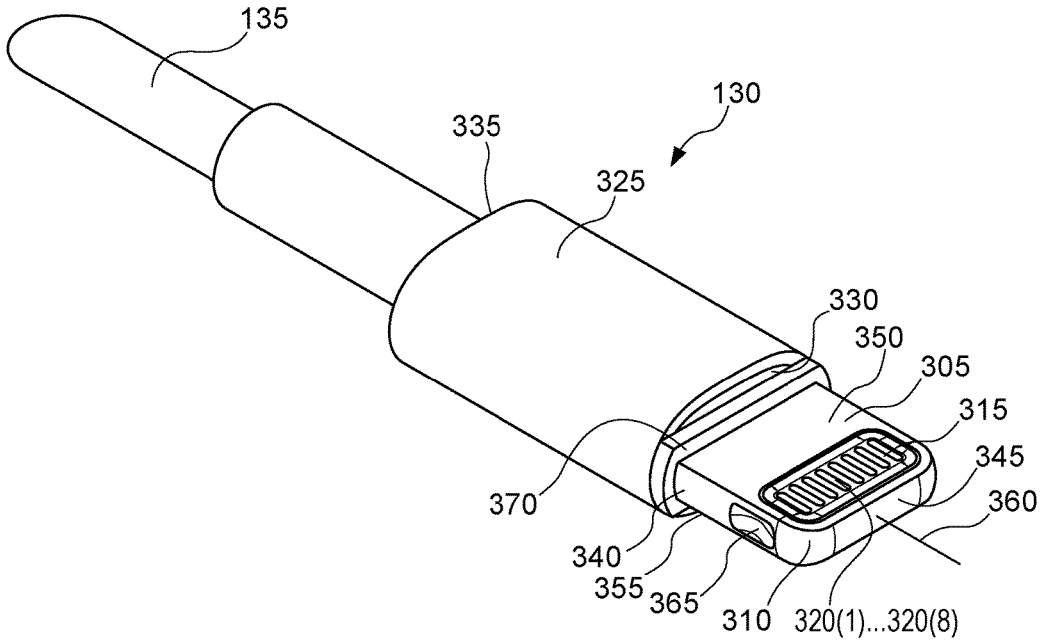
FIG. 3 is an isometric view of a plug connector including a seal according to an embodiment of the disclosure.

Now referring to FIG. 3 a larger view of plug connector 130 is illustrated. Plug connector 130 includes a connector tab 305 that is sized to be inserted into a cavity (not shown) in corresponding receptacle connector 115 (see FIG. 1). Tab 305 includes a metal ground ring 310 that surrounds a contact region 315. Contact region 315 may contain a first plurality of external elongated electrical contacts 320(1) . . . 320(8) retained in a dielectric frame. This particular embodiment has eight electrical contacts, however other embodiments may have more or less electrical contacts.

Contacts 320(1) . . . 320(8) need not be external and may have a variety of shapes such as, but not limited to square, round, leaf springs or cantilevered beams. Connector 130 further comprises a connector body 325 having tab 305 coupled to and extending out of a first face 330 of the body and cable 135 extending out of a second, opposite, face 335 of the body. Connector tab 305 extends out of first face 330 from a base portion 340 at an interface (not shown in FIG. 3) between body 130 and tab 305 to a distal end 345. In some embodiments connector tab 305 may be double sided, including first and second surfaces 350, 355, respectively where each surface has one or more electrical contacts. In yet further embodiments tab 305 may form a portion of an axisymmetric connector that can be mated with a receptacle connector in both a first orientation and a second orientation, wherein the second orientation is rotated 180 degrees along axis of symmetry 360 from the first orientation. Axis of symmetry 360 is an axis along which at least tab 305 is symmetrical. In some embodiments this may result in two contact regions 315 while in other embodiments tab 305 may only have one contact region. In various embodiments, plug connector 130 may have one or more retention features 365, shown in FIG. 3 as a recess, that can be used to retain the plug connector in a mated position, as discussed in more detail below.

Plug connector 130 may also include a deformable seal 370 positioned around a perimeter of base portion 340 of connector tab 305 such that when the plug connector is mated with electronic device 100 (see FIG. 1) a liquid-tight seal is formed between the plug connector and the electronic device. A liquid-tight seal can be used to prevent moisture from entering receptacle connector 115 (see FIG. 1) of electronic device 100 and causing damage to connector contacts and/or circuitry within the electronic device. In some embodiments seal 370 may be manufactured as a separate component and glued or adhered to plug connector 130 while in other embodiments the seal may be formed or insert-molded onto the plug connector.

Figure 4:
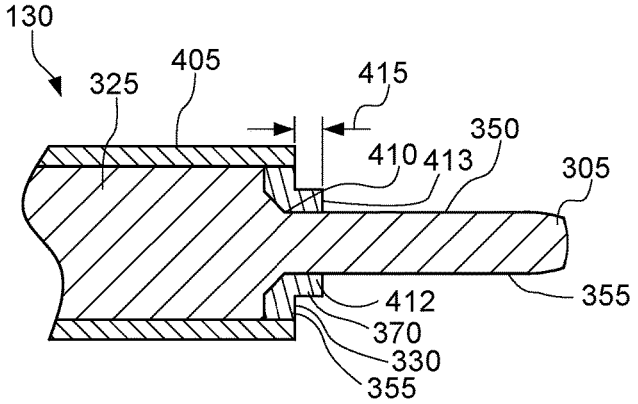
FIG. 4 is a partial cross-sectional view of the plug connector illustrated in FIG. 3.

Now referring to FIG. 4 a cross-section of a portion of plug connector 130 is shown. In this embodiment, seal 370 extends between an outer shell 405 and connector tab 305 fully surrounding a cross-sectional portion of connector tab 305 at interface 410 where the connector tab extends out of body 325. By fully surrounding connector tab 305, a complete seal can be formed between the plug connector and the receptacle connector as discussed with respect to FIG. 5 such that liquid cannot penetrate between connector 130 and electronic device 100 when the connectors are fully mated as shown in FIG. 2. In the embodiment illustrated in FIG. 4, seal 370 is in direct contact with both body 325 and connector tab 305 and includes a protruding portion 412 that extends towards a distal end of connector tab 305 forming a step between outer shell 405 and connector tab 305 along first and second surfaces 350, 355 of the connector tab. Seal 370 also includes a sealing face 413 that extends outward from first and second surfaces 350, 355 towards outer shell 405. In some embodiments seal 370 is formed across only a portion of first face 330 (as illustrated in FIGS. 3 and 4), however in other embodiments it may be formed across the entire first face 330, as discussed in more detail below. In various embodiments seal 370 extends away from first face 330 a distance 415 between 0.1 and 2 millimeters. In some embodiments distance 415 is between 0.15 and 1 millimeters while in various embodiments distance 415 may be between 0.2 and 0.3 millimeters.

Figure 5:
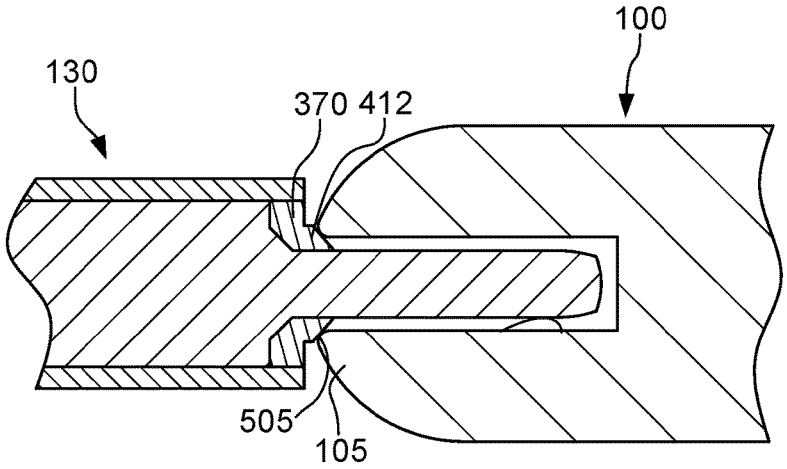
FIG. 5 is a partial cross-sectional view of the plug connector illustrated in FIG. 3 when it is engaged with an electronic device.

Now referring to FIG. 5, a cross-section of plug connector 130 mated with electronic device 100 is illustrated. As shown in FIG. 5, when plug connector 130 is fully mated with the receptacle connector of device 100 protruding portion 412 of seal 370 is in direct contact with a portion of exterior housing 105 around a periphery of a receiving opening 505 deforming the seal. The deformed seal forms a liquid-tight barrier between the plug connector and the electronic device that fully surrounds the opening of the receptacle connector of electronic device 100. In some embodiments plug connector 130 may have one or more retention features, such as features 365 in FIG. 3, that retain the plug connector in a mated position such that the liquid-tight seal is maintained until a user unplugs the plug connector.

In some embodiments seal 370 may be made from a silicone, elastomer or rubber having an appropriate hardness (i.e., durometer) such that it conforms to receiving opening 505 when pushed against electronic device 100 and held in place by retention features 365 (see FIG. 3). In various embodiments seal 370 has a hardness between 1 and 90 (Shore A) while in some embodiments the hardness may be between 20 and 40 (Shore A) and in one embodiment between 25 and 35 (Shore A). In some embodiments the hardness, the dimensions and/or the geometry of seal 370 can be modified such that a liquid-tight seal to electronic device 100 is formed with higher or lower levels of applied force between plug connector 130 and electronic device 100, as discussed in more detail below. In various embodiments seal 370 may be made from a hydrophilic material, designed to swell when exposed to water, while in other embodiments it may be designed from a hydrophobic material designed to repel water.

As defined herein, a liquid-tight seal shall mean a seal that conforms to one or more of the following ratings as defined by the International Protection Rating and International Electrochemical Commission (IEC) 60529 that may also be known as the I.P.68 rating. In some embodiments the liquid-tight seal will protect the electronic device against the harmful ingress of water and have a "liquid ingress" rating between 1 (dripping water) and 8 (immersion beyond 1 meter). In various embodiments the liquid-tight seal shall be rated between 1 (dripping water) and 4 (splashing water) while in some embodiments the liquid-tight seal shall be rated between 2 (dripping water with device tilted at 15 degrees) and 5 (water jet). In various embodiments the liquid-tight seal shall be rated between 3 (spraying water) and 6 (powerful water jets) while in some embodiments the liquid-tight seal shall be rated between 4 (splashing water) and 7 (immersion up to 1 meter). In various embodiments the liquid-tight seal shall be rated between 5 (water jets) and 8 (immersion beyond 1 meter) while in some embodiments liquid-tight shall mean the seal will protect the electronic device against liquid ingress up to 100 feet for 30 minutes.

Now referring to FIGS. 6-10 various seal configurations on plug connectors are illustrated that can be used to alter both the force versus deflection characteristics of the seal, as well as changing the geometry of the sealing surface of the seal. These alterations may be useful to form a liquid-tight seal with different levels of applied force and different plug retention mechanisms. For example, if a magnetic retention mechanism were used, a seal having a lower force versus deflection characteristic may be desired. These are merely examples and other variations of seal designs for plug connectors are within the scope of this disclosure. In each of the examples illustrated in FIGS. 6-10, the described seal can be made from any of the same materials described above that can be used to form seal 370.

Figure 6A:
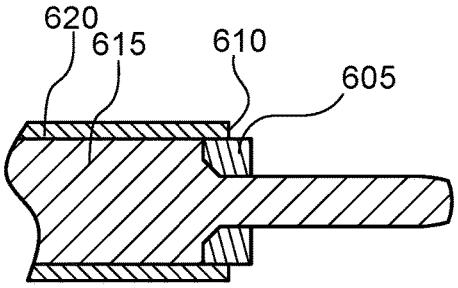
FIG. 6A is a partial cross-sectional view of a plug connector including a seal with an enlarged interface area according to an embodiment of the disclosure.
Figure 6B:
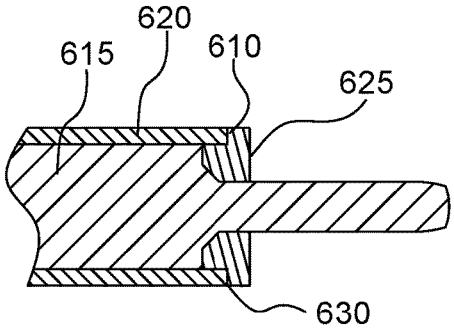
FIG. 6B is a partial cross-sectional view of a plug connector including a seal with an enlarged interface area according to an embodiment of the disclosure.
Figure 6C:
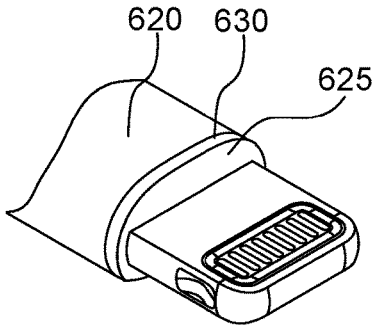
FIG. 6C is a partial isometric view of a plug connector including a seal with an enlarged interface area according to an embodiment of the disclosure.

Now referring to FIGS. 6A-6C, two embodiments of a seal formed across a majority of first face 610 are shown. In a first embodiment illustrated in FIG. 6A, a seal 605 is similar to seal 370 in FIG. 5 is used, however seal 605 does not have a stepped sealing surface and the seal is formed across a majority of first face 610 of body 615. Seal 605 ends before it reaches outer shell 620. However, in FIGS. 6B and 6C a similar embodiment is illustrated that has a seal 625 also formed across a majority of first face 610, however in this embodiment seal 625 extends to an outer edge 630 of outer shell 620. The embodiments in FIGS. 6A-6C may exhibit a higher force per given displacement than seal 370 in FIG. 5 due to the greater amount of displacement of seal material during a mating event.

Figure 7:
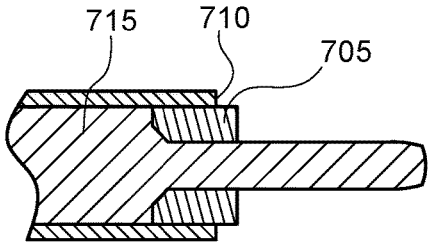
FIG. 7 is a partial cross-sectional view of a plug connector including a seal having an extended length according to an embodiment of the disclosure.

Now referring to FIG. 7, an embodiment similar to FIG. 6 is illustrated, having a seal 705 formed across a majority of first face 710 of body 715, however in this embodiment seal 705 is recessed into body 715 a larger distance such that the seal will have a lower force per given displacement (i.e., spring rate) than seal 605 in FIG. 6.

Figure 8:
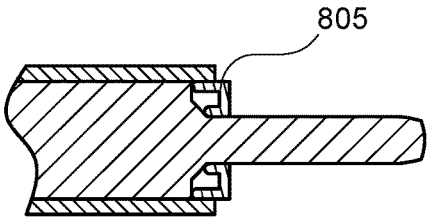
FIG. 8 is a partial cross-sectional view of a plug connector including a seal having a "U-shaped" cross-section according to an embodiment of the disclosure.
Figure 9:
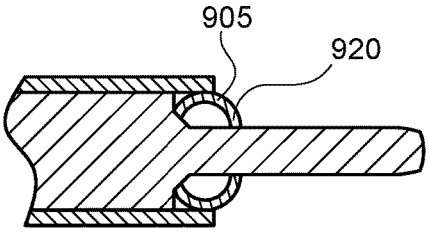
FIG. 9 is a partial cross-sectional view of a plug connector including a seal having a curved cross-section according to an embodiment of the disclosure.
Figure 10:
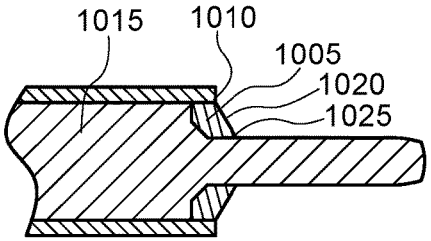
FIG. 10 is a partial cross-sectional view of a plug connector including a seal having a tapered interface region according to an embodiment of the disclosure.

Now referring to FIG. 8 another embodiment of a seal 805 is illustrated showing a seal that has a cross-sectional profile resembling a "U" shape, giving it a smaller cross-sectional area and a lower force for a given displacement (i.e., spring rate). FIG. 9 illustrates a seal 905 that is similar to FIG. 8, having a reduced cross-sectional area, however FIG. 9 is formed in a semicircular shape such that an interface surface 920 of the seal is curved. Finally, FIG. 10 illustrates a seal 1005 that is formed across a majority of first face 1010 of body 1015 similar to seals 605 and 705 in FIGS. 6 and 7, respectively, however seal 1005 in FIG. 10 has a tapered interface surface 1020 allowing a distal portion 1025 of the seal to contact the electronic device first.

Figure 11A:
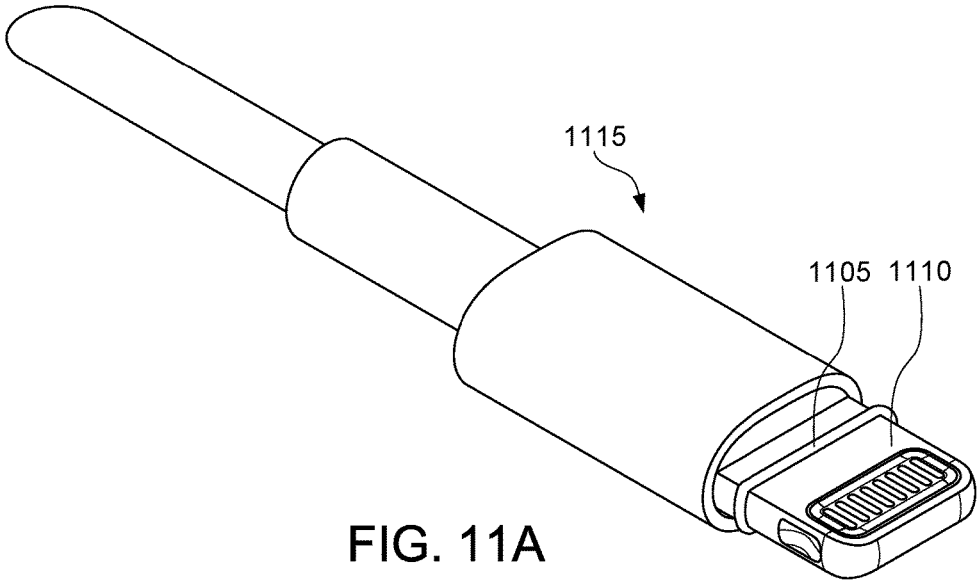
FIG. 11A is an isometric view of a plug connector including an O-ring seal according to an embodiment of the disclosure.
Figure 11B:
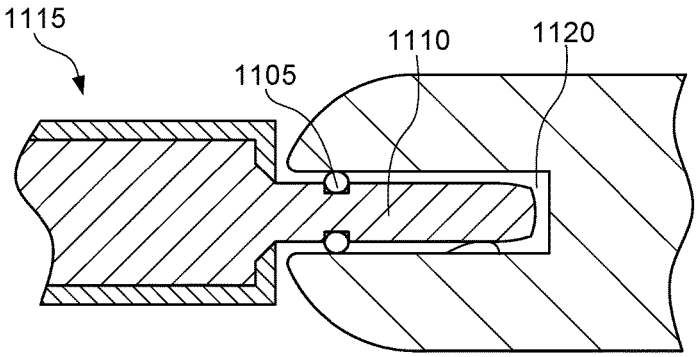
FIG. 11B is a partial cross-sectional view of the plug connector illustrated in FIG. 11A installed in a receptacle connector.

Now referring to FIGS. 11A through 12B, alternate methods of forming a seal between a plug connector and an electronic device with a seal formed on the plug connector are illustrated. An isometric view of a plug connector 1115 with an O-ring or similar type of seal 1105 is illustrated in FIG. 11A. A cross-section of plug connector 1115 inserted within a receptacle connector of an electronic device is illustrated in FIG. 11B. Seal 1105 is formed around tab 1110 of plug connector 1115 and into a corresponding groove. Seal 1105 is compressed between tab 1110 and cavity 1120 of the receptacle connector of the electronic device forming a liquid-tight seal.

Figure 12A:
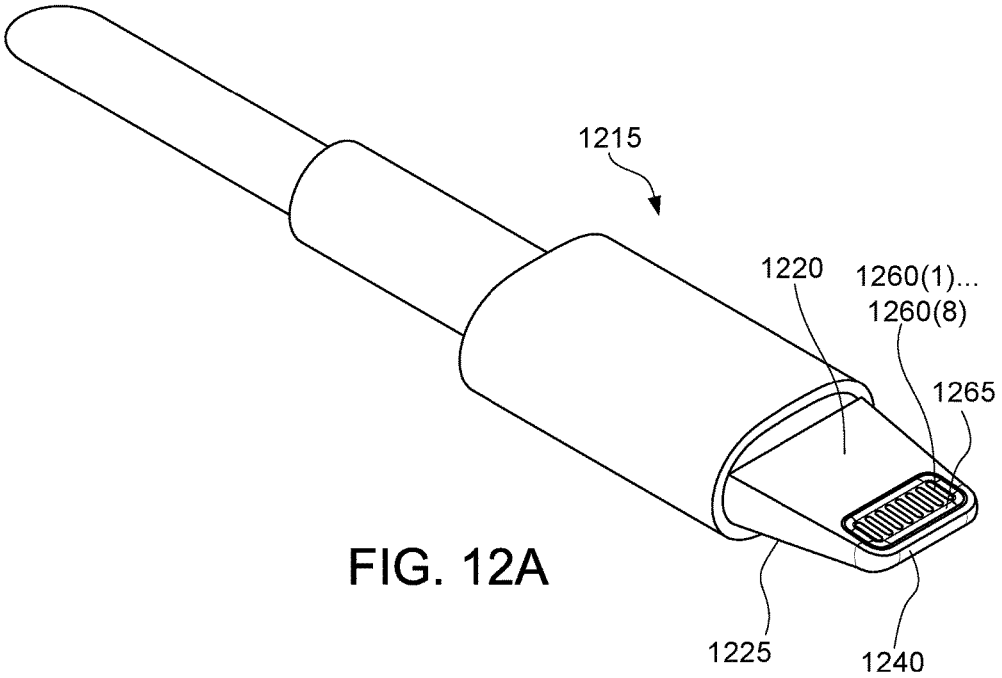
FIG. 12A is an isometric view of a plug connector including tapered tab seal according to an embodiment of the disclosure.
Figure 12B:
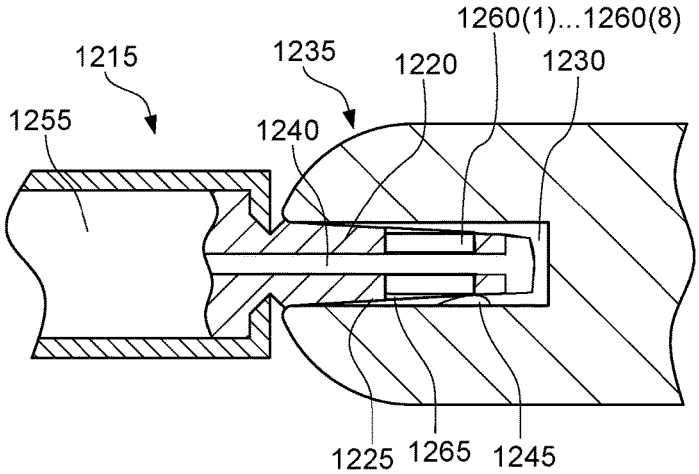
FIG. 12B is a partial cross-sectional view of the plug connector illustrated in FIG. 12A installed in a receptacle connector.

Now referring to FIG. 12A, an isometric view of plug connector 1215 is shown having first surface 1220 and second opposing surface 1225 that are tapered and formed from a deformable material configured to form a seal to a receptacle connector of an electronic device. FIG. 12B illustrates a cross-sectional view of plug connector 1215 installed in a receptacle connector of an electronic device. First surface 1220 and second surface 1225 form a liquid-tight seal to a receptacle connector cavity 1230 of electronic device 1235 as they are inserted within cavity 1230. In some embodiments plug connector 1215 may include an internal frame 1240 formed from a metal or other rigid material so the plug connector can retain its shape and hold plurality of contacts 1260(1) . . . 1260(8) in place so they may make contact with receptacle contacts 1245. Plug connector 1215 may have a contact region 1265 that may retain plurality of electrical contacts 1260(1) . . . 1260(8) in a dielectric frame. This particular embodiment has eight electrical contacts, however other embodiments may have more or less electrical contacts.

In other embodiments (not illustrated in FIGS. 12A and 12B) a front portion of tab 1290 may have an enlarged "bulbous" cross-section and may be made from a deformable seal material such that it forms a liquid-tight seal towards an end of cavity 1230. In a further embodiment an entire, or a large portion of body 1255 can be made from a deformable material, such as the seal material disclosed herein, and can form a liquid-tight seal to electronic device 1235. More specifically, in one embodiment body 1255 may be coated with a deformable material.

Seals for Receptacle Connectors

Figure 13A:
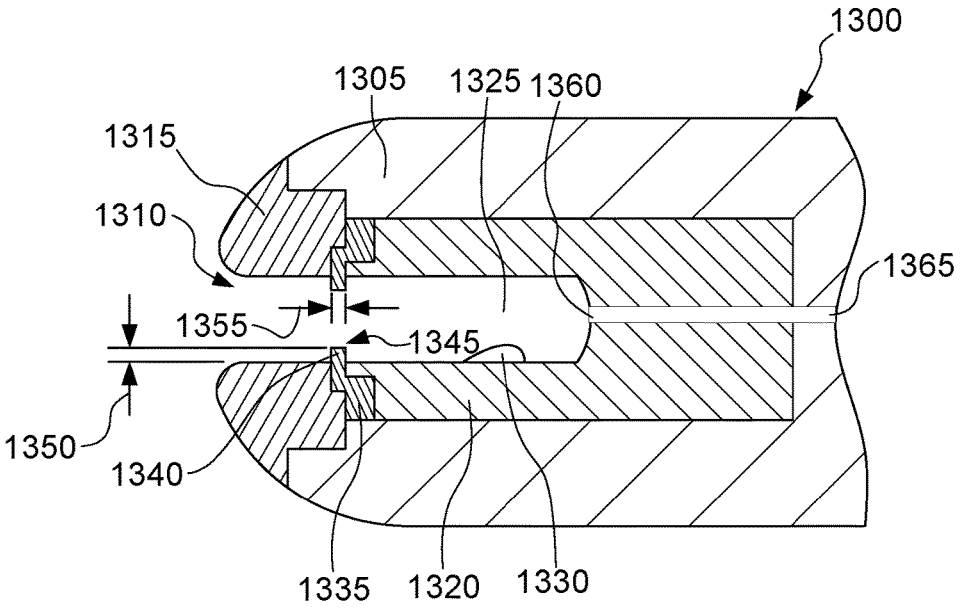
FIG. 13A is a partial cross-sectional view of an electronic device including an internal seal according to an embodiment of the disclosure.
Figure 13B:
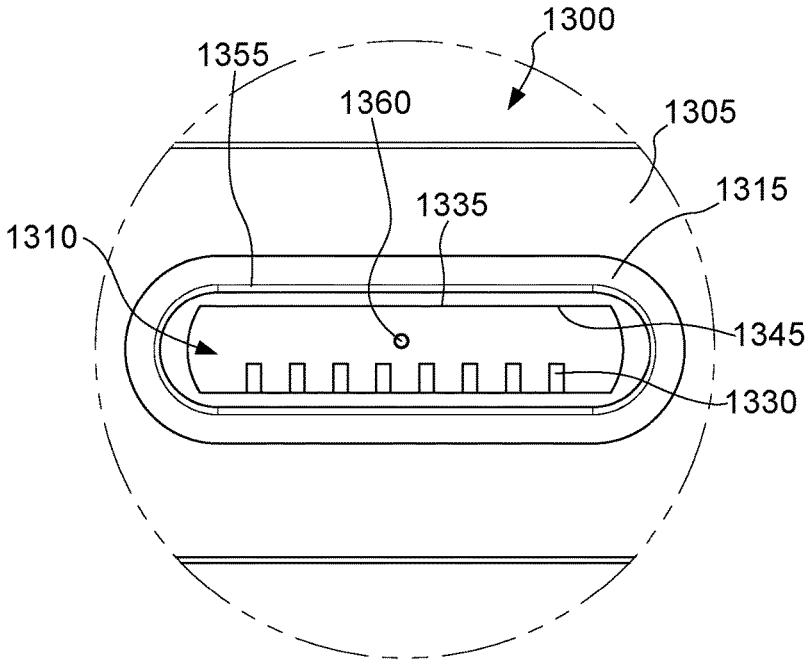
FIG. 13B is a view of the receptacle connector opening of the electronic device illustrated in FIG. 13A.
Figure 14:
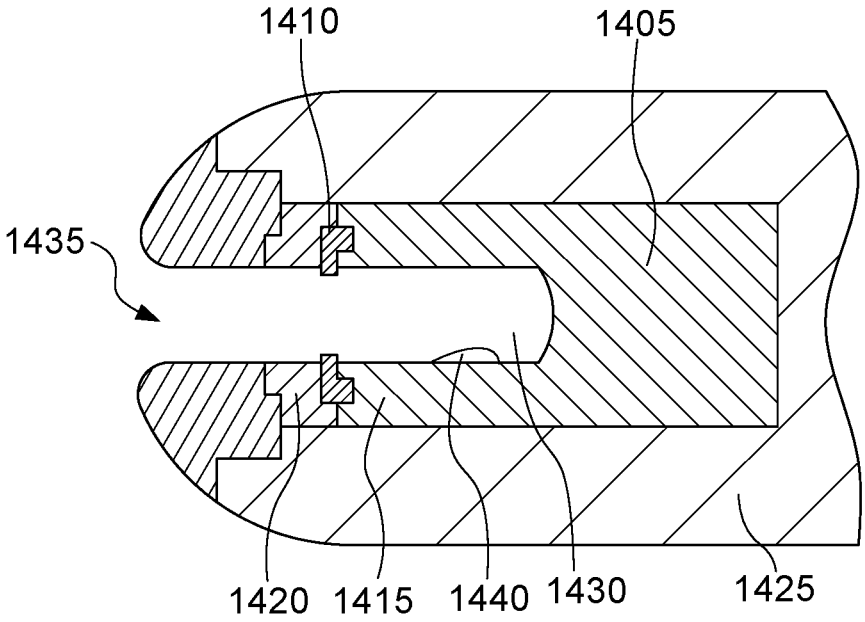
FIG. 14 is a partial cross-sectional view of a receptacle connector for an electronic device that includes an internal seal according to an embodiment of the disclosure.

Now referring to FIGS. 13A-14, embodiments of electronic devices and receptacle connectors that include one or more seals within them are illustrated. These embodiments can form a liquid-tight seal to a plug connector that may not be equipped with a seal, as discussed in more detail below.

For example, FIG. 13A illustrates a partial cross-section of an electronic device 1300 that may be similar to electronic device 100 in FIG. 1. In this embodiment, electronic device 1300 has an exterior housing 1305 having a receiving opening 1310. In this particular embodiment, a portion of exterior housing 1305 includes a trim ring 1315 with receiving opening 1310 formed within the trim ring. A receptacle connector 1320 is positioned within exterior housing 1305 and has a cavity 1325 that communicates with receiving opening 1310. A plurality of electrical contacts 1330 are disposed within cavity 1325 and are positioned to make contact with a corresponding plug connector, such as plug connector 130 in FIG. 1.

A deformable peripheral seal 1335 is positioned between receiving opening 1310 and plurality of internal contacts 1330. More specifically, in this embodiment a portion of peripheral seal 1335 is positioned between trim ring 1315 and receptacle connector 1320. Peripheral seal 1335 has a sealing portion 1340 extending towards a center of cavity 1325, forming a seal aperture 1345 having dimensions smaller than receiving opening 1310. Seal aperture 1345 is also shown in FIG. 13B which is a view looking into receptacle connector 1320 from the exterior of electronic device 1300.

Receiving opening 1310 has an aperture that is larger than seal aperture 1345. As used herein, aperture dimension shall be defined as the size of a two-dimensional opening (e.g., for a rectangular opening the aperture dimension includes both the length and width of the opening). In some embodiments the larger aperture dimension of receiving opening 1310 allows plug connector 130 (see FIG. 1) to be easily mated with electronic device 1300 since trim ring 1315 may be made from a relatively hard material such as a metal or a plastic. The smaller seal aperture 1345 dimension of seal 1335 allows the seal to conform to the plug connector tab 305 (see FIG. 3) and form a liquid-tight seal. In some embodiments this configuration may have the benefit of performing a "wiping" action on contacts 320(1) . . . 320(8) (see FIG. 3) of plug connector 130. More specifically, as plug connector is inserted into cavity, seal 1335 can wipe contacts 320(1) . . . 320(8) (see FIG. 3) of liquid and/or debris before the contacts enter cavity 1325 and make electrical connection with internal contacts 1330.

As illustrated in FIG. 13A, in some embodiments seal 1335 may protrude into cavity 1325 a distance 1350 between 25 and 400 microns while in various embodiments it may protrude between 25 and 200 microns and in one embodiment it may protrude between 50 and 100 microns. In some embodiments seal 1335 may have a width 1355 between 25 microns and 800 microns while in various embodiments it may have a width between 50 and 300 microns and in one embodiment between 100 and 150 microns wide. In various embodiments a vacuum port 1360 is disposed within cavity 1325 and may be coupled with a duct 1365 to a vacuum generator (not shown), as discussed in more detail with regard to FIGS. 19-23.

Now referring to FIG. 14 another embodiment of a receptacle connector 1405 is illustrated having a peripheral seal 1410 positioned to form a liquid-tight seal to a plug connector is illustrated. As compared to the embodiment illustrated in FIGS. 13A and 13B, this embodiment has a peripheral seal 1410 that is formed as a portion of receptacle connector 1405. In some embodiments receptacle connector 1405 can be made from two components secured together such that they captivate seal 1410 holding it in place. More specifically, receptacle connector 1405 may include a connector portion 1415 and a ring portion 1420 where the ring portion is secured to the connector portion. Ring portion 1420 may be secured to connector portion 1415 with adhesive, fasteners or welding, including ultrasonic welding. In other embodiments seal 1410 may be insert molded in place within receptacle connector 1405. Seal 1410 is positioned between receiving opening 1435 and contacts 1440 such that moisture cannot reach the contacts. In some embodiments it may be beneficial to have seal 1410 assembled during the assembly of receptacle connector 1405 and not during assembly of electronic device 1425 to simplify assembly of the electronic device. In further embodiments this configuration may allow seal 1410 to be positioned deeper within cavity 1430 such that it is less visible to a user and provides an improved aesthetic appearance.

In some embodiments seals that are positioned on the plug can be used in conjunction with seals positioned within the electronic device and/or with seals that are positioned within the receptacle connector. In various embodiments two internal seals such as seal 1335 in FIG. 3A and seal 1410 in FIG. 14 can be used together. One may function as a primary and the other as a secondary seal. Further, seal 1335 may serve as a wiper and seal 1410 may serve as a seal. In further embodiments all three seals may be used in conjunction with one another, that is seal 1335, seal 1410 and a plug seal such as seal 370 in FIG. 3.

Seals for Connector Plugs with Internal Contacts

Figure 15A:
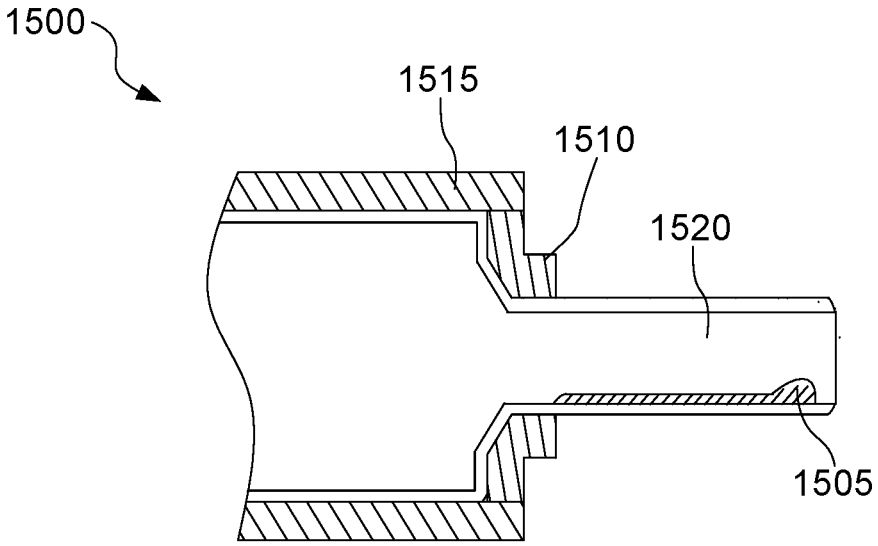
FIG. 15A is a partial cross-sectional view of a plug connector with internal contacts according to an embodiment of the disclosure.
Figure 15B:
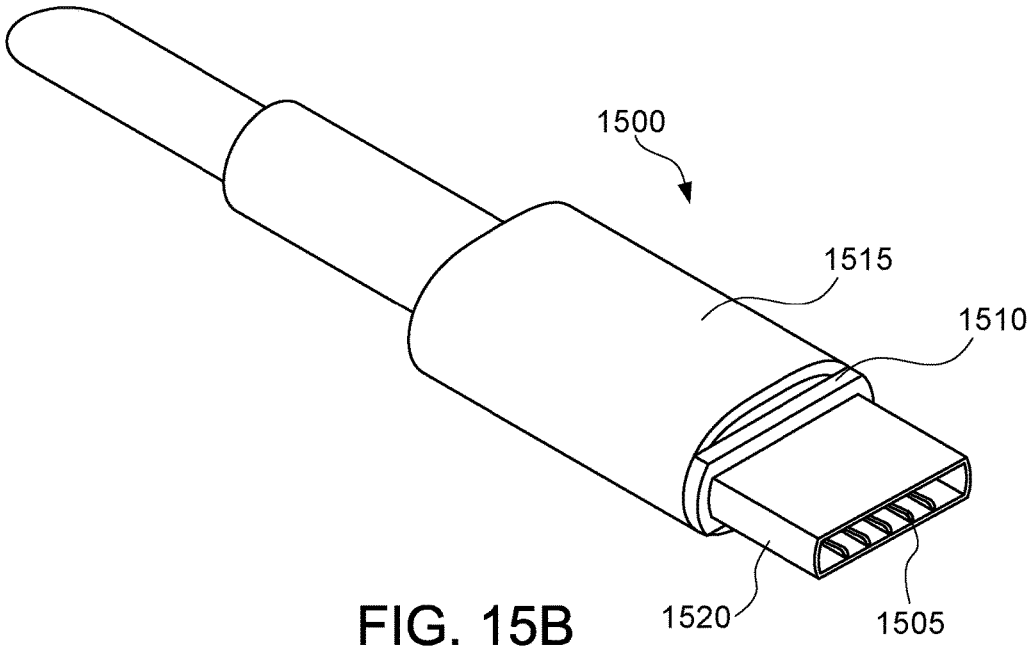
FIG. 15B is an isometric view of the plug connector illustrated in FIG. 15A.

Now referring to FIG. 15A, a cross-section of plug connector 1500 is illustrated that is similar to plug connector 130 illustrated in FIG. 3, however plug connector 1500 has internal contacts 1505. FIG. 15B illustrates an isometric view of plug connector 1500. In this embodiment, a seal 1510 extends between an outer shell 1515 and a connector tab 1520 fully surrounding a cross-sectional portion of the connector tab. By fully surrounding connector tab 1520, a complete seal can be formed between the plug connector and the receptacle connector as illustrated in FIG. 5 such that liquid cannot penetrate between the connector and the electronic device when the connectors are fully mated as shown in FIG. 2.

Sealed Accessories for Electronic Devices

Figure 16:
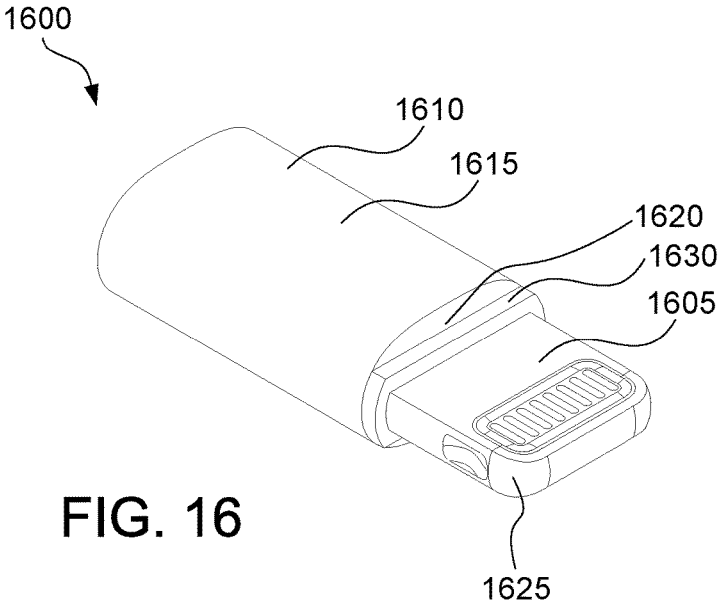
FIG. 16 is an isometric view of an accessory having a plug connector according to an embodiment of the disclosure.

Now referring to FIGS. 16-24 various accessories, which may also be referred to as modules herein, are disclosed. These accessories may be mated to a corresponding electronic device and perform one or more functions, as explained in more detail below. FIG. 16 illustrates an isometric view of an example accessory 1600 having a plug connector 1605 that is similar to plug connector 130 illustrated in FIG. 3, however accessory 1600 does not have a cable attached to it. Accessory 1600 may include a body 1610 with an exterior housing 1615 having a first face 1620. Plug connector 1605 may include a connector tab 1625 that extends away from first face 1620. A seal 1630 may be positioned around connector tab 1625 and against first face 1620 such that the seal fully surrounds a cross-sectional portion of the connector tab at a region where the connector tab extends out of exterior housing 1615. Seal 1630, which can be implemented as any of the seals described above including seals 370, 605, 705, 805, 905, 1005 and 1105, can form a liquid-tight seal to an enclosure of an electronic device when the plug connector is mated with the receptacle connector of the electronic device. As described, seal 1630 is one example of a suitable seal for accessory 1600 only and other configurations of seal 1630 are within the scope of this disclosure.

In a first example, one of the functions that accessory 1600 may perform is to seal receptacle connector 115 (see FIG. 1) of electronic device 100 (see FIG. 1) using seal 1630 such that the receptacle connector of the electronic device is protected from moisture and/or debris. Accordingly, in some embodiments accessory 1600 including exterior housing 1615, is liquid-tight. In another example, exterior housing 1615 of accessory 1600 may be buoyant and provide a means of flotation for electronic device 100 (see FIG. 1). In a further example, accessory 1600 may include a light source that functions as a flashlight, a camera illuminator, an underwater light or performs any other illumination function.

Accessory 1600 may perform myriad other functions where seal 1630 may be beneficial to mitigate the ingress of liquid and/or debris within receptacle connector 115 (see FIG. 1) of electronic device 100. In one example accessory 1600 may include one or more sensors for detecting one or more parameters of a liquid. The one or more sensors may be able to communicate data through the mated connectors to the electronic device. Some example parameters that can be detected are pressure, temperature and chemical properties such as, but not limited to pH level, resistivity and mineral content of a liquid.

In a further example accessory 1600 may include a camera (not shown in FIG. 16) that can capture images outside of exterior housing 1615 and a microphone that captures sound in or out of water. In one specific example accessory 1600 may be an underwater camera that captures video or still images. In further examples accessory 1600 may function as a WiFi, satellite or other type of antenna, including an underwater antenna or SONAR device. In another example accessory 1600 may include a power source that can be recharged and supply power to the accessory and/or the electronic device. In some embodiments various functions of accessory 1600 can be controlled by one or more buttons on the accessory, or through the electronic device that communicates with the accessory through plug connector 1605. The shape and configuration of accessory 1600 illustrated in FIG. 16 is for example only and myriad other configurations of accessory are within the scope of this disclosure. For example, in some embodiments accessory 1600 may have a display, as described in more detail below.

Figure 17:
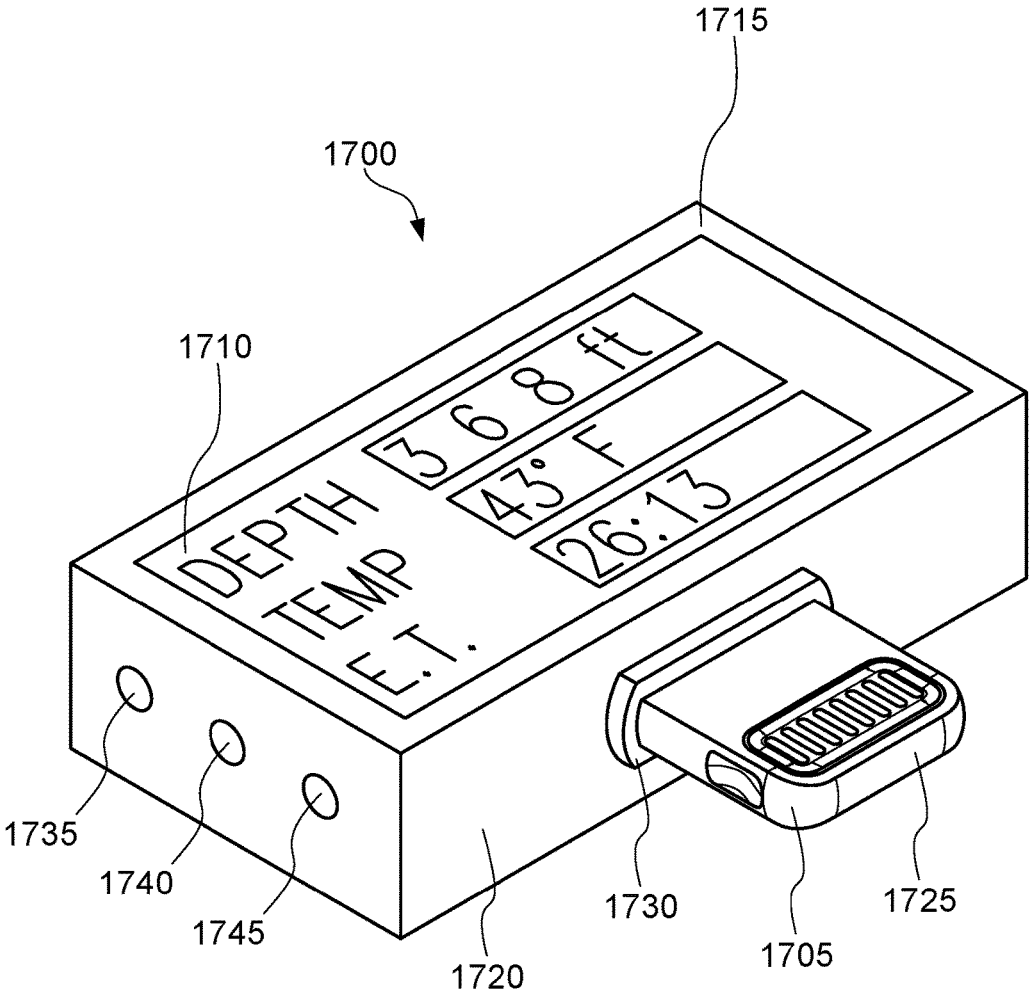
FIG. 17 is an isometric view of an accessory having a plug connector and a display that shows diving data according to an embodiment of the disclosure.
Figure 18:
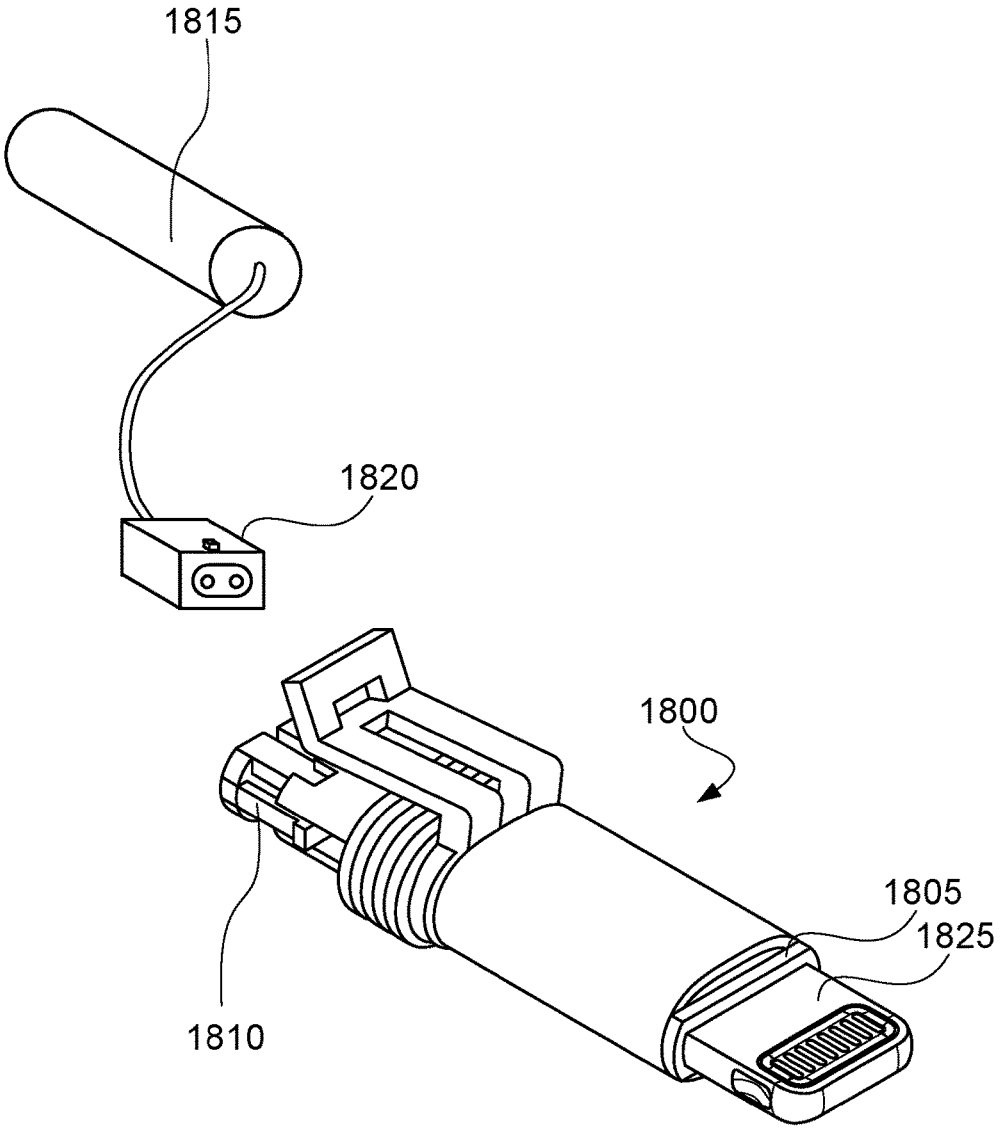
FIG. 18 is an isometric view of an accessory having a second liquid-tight plug connector according to an embodiment of the disclosure.

Now referring to FIG. 17, an isometric view of an accessory 1700 that is similar to accessory 1600 illustrated in FIG. 16, however accessory 1700 has a display 1710. Display 1710 may be used to display pertinent information to a user such as, for example, diving information when a user is SCUBA diving.

Accessory 1700 may include a plug connector 1705 that is similar to plug connector 130 illustrated in FIG. 3. Accessory 1700 may further include an exterior housing 1715 having a first face 1720. Plug connector 1705 may have a connector tab 1725 that extends away from first face 1720. A seal 1730 may be positioned around connector tab 1725 and against first face 1720 such that the seal fully surrounds a cross-sectional portion of the connector tab at a region where the connector tab extends out of exterior housing 1715. Seal 1730 can be implemented as seal 1630 and form a liquid-tight seal to an enclosure of an electronic device when the plug connector is mated with the receptacle connector of the electronic device In some embodiments accessory 1700 may have a display 1710 that can communicate information to a user. In this example, display 1710 communicates a diving depth, water temperature and the elapsed dive time (E.T.) of the dive. Accordingly, in some embodiments accessory 1700, including exterior housing 1715 is liquid-tight and may have one or more sensors 1735 that enable it to sense its depth in water, the temperature of the water and/or dive time or other parameters that may be of interest when under water. In further embodiments other parameters such as oxygen tank level, heart rate, and/or water clarity can be sensed and/or communicated to a user. These are only examples and myriad other parameters may be displayed.

In further examples accessory 1700 may have alarm functions for a predetermined depth, temperature and/or dive time. The alarm function may include a flashing light and/or an acoustic device that can be seen and/or heard underwater. The acoustic device may include a speaker 1740 secured to exterior housing 1715 and configured to emit sound outside of the housing. In some embodiments the emitted sound may be through the air (e.g., a speaker system for use at the poolside) while in other embodiments the emitted sound may be through the water (e.g., an underwater diver alert tone or an underwater shark deterrent).

In further examples accessory 1700 may be equipped with an illumination source 1745 and/or an internally rechargeable power source (not shown in FIG. 17) to provide backup power to the electronic device it is plugged into. In yet further examples accessory 1700 may be equipped with any type of camera including a video camera that may be useful for underwater photography. Myriad features and functions may be integrated within accessory 1700 that may be useful when electronic device 100 (see FIG. 1) is exposed to moist and/or dirty environments.

In further examples accessory 1700 can be used as an accessory for a smart fishing rod that reads out, for example, line distance, line tension and/or elapsed time. In yet other examples, accessory 1700 may have a second electrical connector that is also liquid-tight and configured to couple the accessory to another device, as described in more detail below.

Now referring to FIG. 1800, an isometric view of an accessory 1800 that is similar to accessories 1600 and 1700 illustrated in FIGS. 16 and 17, respectively, however accessory 1800 has a second liquid-tight connector 1810. Second liquid-tight connector 1810 may be used to couple accessory 1800 and/or electronic device 100 (see FIG. 1) to a separate device that may have a specialized connector interface.

For example, it may be desirable to couple electronic device 100 (see FIG. 1) to a commercially available water testing probe 1815 that has a specialized connector 1820 that is compatible with a water testing meter. In this case accessory 1800 can be used as an interposer to both mechanically and electrically convert between receptacle connector 115 (see FIG. 1) of electronic device 100 and specialized connector 1820 of water testing probe 1815. More specifically, in some embodiments, accessory 1800 may have circuitry within it (not shown in FIG. 18) that enables electronic device 100 (see FIG. 1) to communicate with a device having a specialized connector interface. Plug connector 1825 of accessory 1800 may be similar to plug connector 130 illustrated in FIG. 3 and thus include a seal 1805 similar to seal 305 described with respect to FIG. 3 or seal 1630 described with respect to FIG. 16. In another embodiment accessory 1800 may be used to adapt a set of headphones or other accessory to electronic device 100 (see FIG. 1).

Vacuum Enabled Accessories for Electronic Devices

Now referring to FIGS. 19-23, various accessories that enable a vacuum to be generated between an electronic device and the accessory are disclosed. The vacuum may be generated within the mated connectors of the electronic device and the accessory, assisting in the formation of a liquid-tight seal between the electronic device and the accessory, as discussed in more detail below.

Figure 19:
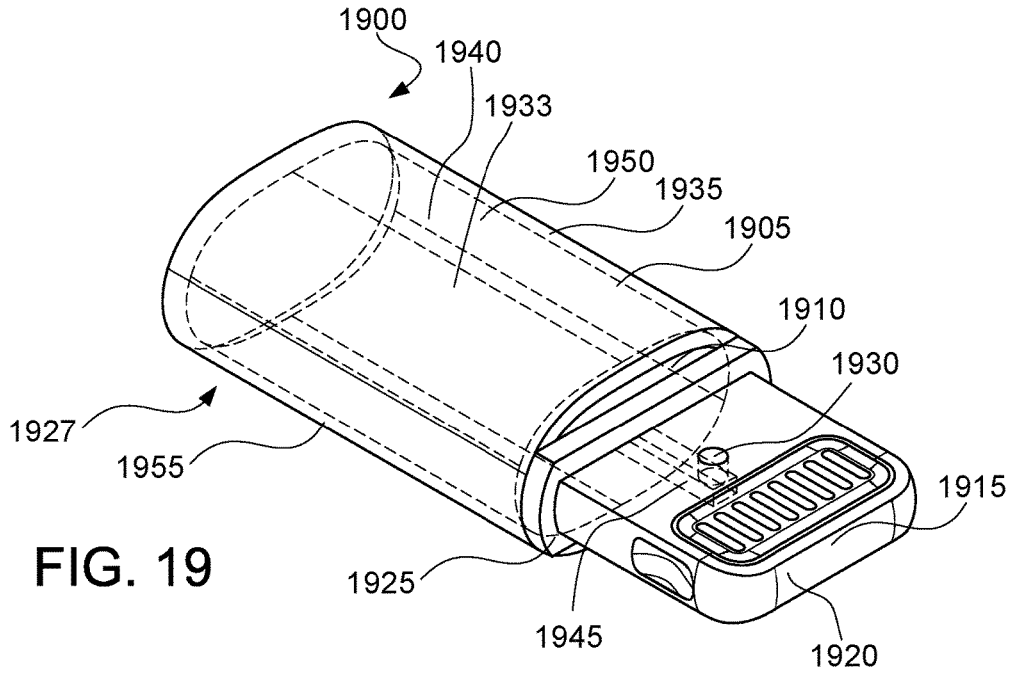
FIG. 19 is an isometric view of an accessory having a vacuum generator coupled to a plug connector according to an embodiment of the disclosure.
Figure 20:
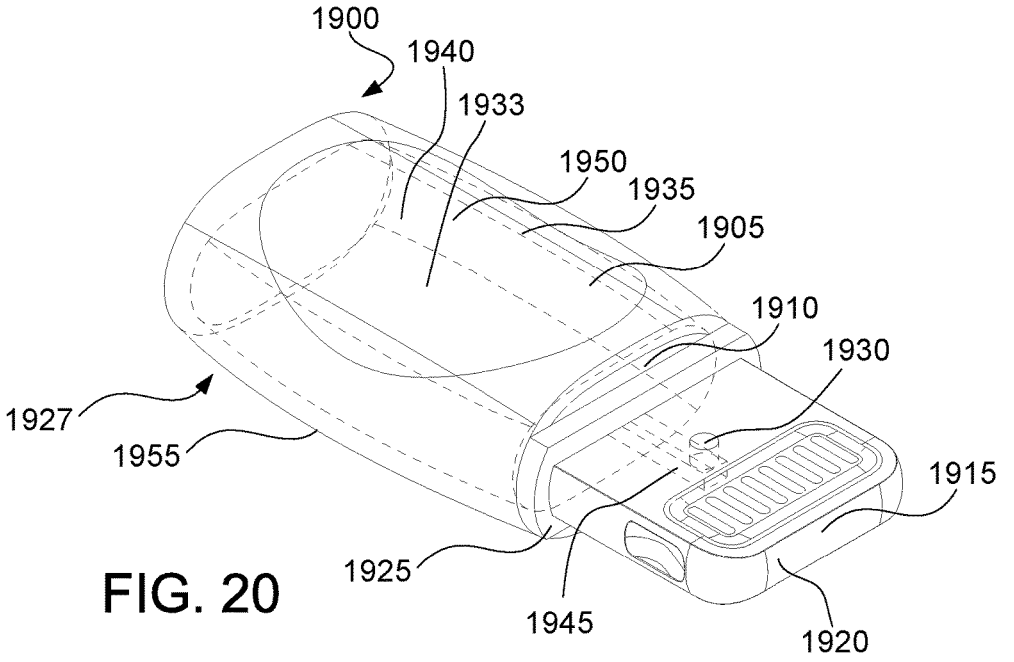
FIG. 20 is an isometric view of the accessory illustrated in FIG. 19 showing a portion of the housing in a deformed state.

Now referring to FIGS. 19 and 20 an accessory 1900 having an exterior housing 1905 with a first face 1910, includes a plug connector 1915 configured to be mated with a receptacle connector 115 (see FIG. 1) of an electronic device, such as electronic device 100 in FIG. 1. Accessory 1900 can be designed and configured to perform a variety of different functions and have a variety of different features and capabilities, such as those described above with respect to accessory 1600 and accessory 1700. Similarly, the shape and size of housing 1905 depicted in FIG. 19 is just one example of housing 1905. Housing 1905 is not limited to any particular size and/or shape and can have any appropriate shape and size in other embodiments.

Plug connector 1915 can be similar to connector 130 described above and can include a connector tab 1920 that extends away from first face 1910. A seal 1925 may be positioned around connector tab 1920 such that it forms a seal with electronic device 100 (see FIG. 1) when plug connector 1915 is mated with receptacle connector 115 (see FIG. 1) of the electronic device.

One notable difference between accessory 1900 and previously described accessories is the inclusion of a vacuum generator 1927 that can be positioned within housing 1905 and coupled to a vacuum port 1930. As shown in FIG. 19, vacuum port 1930 can be open at an exterior surface of connector tab 1920. When connector 1915 is mated with a corresponding receptacle connector, seal 1925 forms a liquid and air-tight seal between the two connectors. Vacuum generator 1927 can be activated prior to or during the mating process to pump air and/or fluid out of the cavity formed between the two mated connectors through a vacuum duct 1945 as described below.

In the embodiment shown in FIGS. 19 and 20, vacuum generator 1927 is a resilient deflectable portion 1933 of exterior housing 1905 that forms at least one wall, or a portion of at least one wall, 1935 of a cavity 1940. Cavity 1940 may be sealed except for vacuum duct 1945 that leads to vacuum port 1930 disposed at the exterior surface of connector tab 1920. Deflectable portion 1933 of housing 1905 may be made from a material such as a flexible plastic, rubber or other material that can be deformed with applied pressure and regains its original shape once the pressure is released. Deflectable portion 1933 may be made from any resilient material. By depressing resilient deflectable portion 1933 of housing 1905, as illustrated in FIG. 20, a user causes an increase in air pressure at port 1930 and subsequently releasing the deflectable portion to return to its original shape, as illustrated in FIG. 19, causes a decrease in air pressure at the port. Thus, the more resilient the material, the more force it will exert when trying to return back to its original shape and the higher the vacuum it will draw at port 1930.

To form a vacuum seal between electronic device 100 (see FIG. 1) and accessory 1900, a user may first depress deflectable portion 1933. The user may then mate receptacle connector 115 (see FIG. 1) of electronic device 100 with plug connector 1915 of accessory 1900 such that seal 1925 forms a seal between the electronic device and the accessory. The user can then release deflectable portion 1933, drawing a vacuum through port 1930. The desired level of vacuum can be designed by selecting the appropriate material for deflectable portion 1933 of housing 1905. The vacuum may be used to retain accessory 1900 in the mated position and may also be used to ensure a liquid-tight seal between the accessory and the electronic device.

To release accessory 1900 from the electronic device, a user may push deflectable portion 1933 enough to release the vacuum, while in other embodiments a vacuum release valve may be included within the accessory and/or within the electronic device, as described in more detail below. In further embodiments a user may push deflectable portion 1933 past the point where pressure is equalized within the mated connectors, causing a positive pressure which will apply a demating (e.g., ejection) force between the electronic device and accessory 1900.

In some embodiments, entire housing 1905 is deflectable while in other embodiments both top surface 1950 and bottom surface 1955 are deflectable and in one embodiment only the top surface is deflectable. In various embodiments, port 1930 may be disposed elsewhere on accessory 1900 such as within a portion of seal 1925 such that it can pull a vacuum within the mated connectors. Further embodiments of accessories may use an electronically actuated vacuum pump as described in more detail below.

Figure 21:
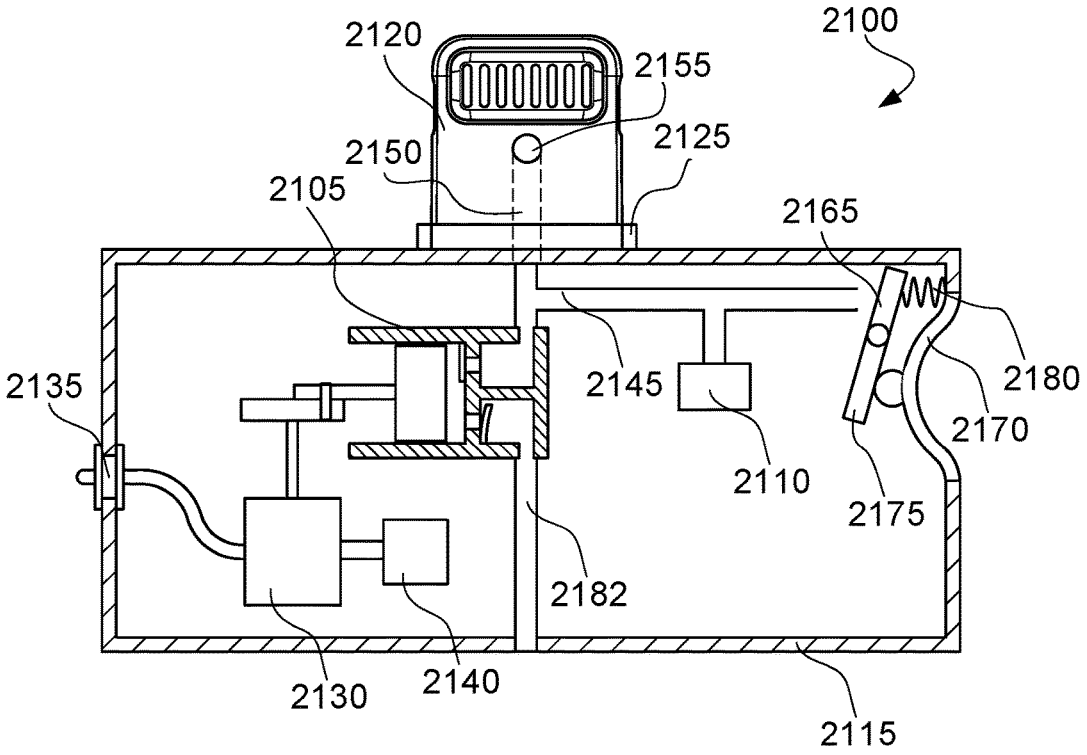
FIG. 21 is a plan view of the internal construction of an accessory having a vacuum generator coupled to a plug connector according to an embodiment of the disclosure.

FIG. 21 illustrates an accessory 2100 that is similar to accessory 1900 in FIGS. 19 and 20 but includes an electronically actuated vacuum generator 2105 and a pressure sensor 2110. Accessory 2100 has an exterior housing 2115 including a plug connector 2120 and a seal 2125. Vacuum generator 2105 can evacuate air and/or fluid out of the cavity formed between seal 2125 and a corresponding receptacle connector with which plug connector 2120 is mated. Vacuum generator 2105 can be coupled to an electric motor 2130 that is operated by an electronic switch 2135 and powered by an internal energy source 2140. However, in other embodiments electric motor 2130 may be controlled and/or powered by electronic device 100 (see FIG. 1) through plug connector 2120.

Vacuum generator 2105 has a vacuum line 2145 routed to a duct 2150 that is terminated with a port 2155 in plug connector 2120. Vacuum line 2145 may be coupled to pressure sensor 2110 that detects air pressure within the vacuum line and communicates associated data to accessory 2100 and/or electronic device 100 (see FIG. 1). In various embodiments the electronic device may operate vacuum generator 2105 until pressure sensor 2110 detects a desired level of vacuum and communicates associated data to the electronic device which in response turns off the vacuum generator. In some embodiments, pressure sensor 2110 may continuously monitor a vacuum level when the connectors are mated and notify the electronic device when the vacuum level has dropped below a threshold value, indicating that the vacuum seal may be compromised.

In some embodiments vacuum line 2145 may also be coupled to a vacuum release valve 2165. For example, in FIG. 21 vacuum release valve 2165 includes a deflectable portion of housing 2170 that can be pushed by a user to operate a lever 2175 against a spring 2180 to open vacuum line 2145, relieving the vacuum. In other embodiments an electronically actuated vacuum release valve may be used and operated by a user interface with electronic device 100 (see FIG. 1) and/or accessory 2100. Other configurations of vacuum release valves are within the scope of this disclosure. Vacuum generator 2105 may also have a discharge line 2182 that discharges air drawn through port 2155 to the external environment. One example of a vacuum generator 2105 that may be used in some embodiments is described in more detail in FIGS. 22 and 23.

Figure 22:
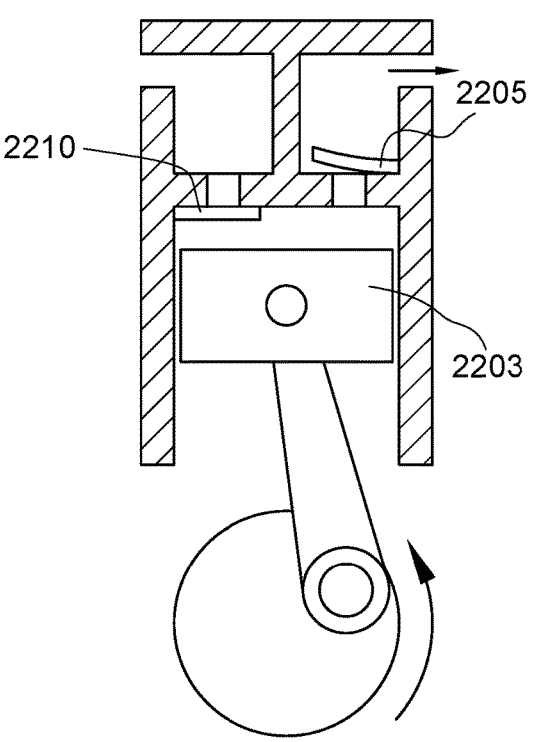
FIGS. 22 and 23 are plan views of a rotary vacuum generator in different states according to an embodiment of the disclosure.
Figure 23:
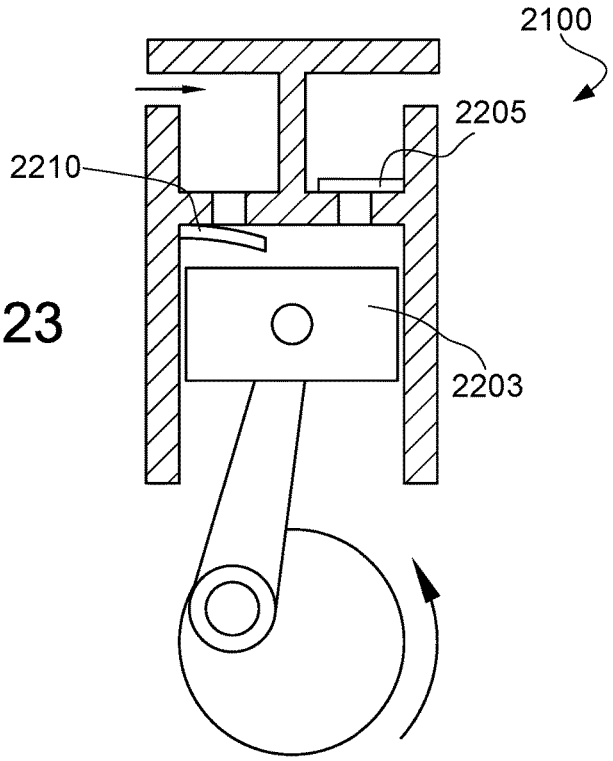

FIGS. 22 and 23 illustrate a piston-type dual diaphragm vacuum generator 2105 that can be used within an accessory, such as accessory 2100 in FIG. 21. FIG. 22 illustrates vacuum generator 2105 at the end of a discharge cycle with piston 2203 traveling upward exhausting vacated air through exhaust valve 2205 and ready to pull a vacuum through vacuum valve 2210. In FIG. 23 piston 2203 is traveling downward, pulling exhaust valve 2205 shut and pulling vacuum valve 2210 open. As piston 2203 continues downward more air is drawn through vacuum valve 2210 and a vacuum level within a mated pair of connectors can be increased. Once piston 2203 is at the bottom of the stroke the piston starts traveling upward again forcing vacuum valve 2210 closed and exhaust valve 2205 open. As piston 2203 travels up, all the air drawn in is exhausted and the piston is ready to draw additional vacuum through vacuum valve 2210.

Other embodiments may use alternative configurations for vacuum generators and this disclosure is not limited to the vacuum generators described herein. For example, various embodiments may use an electromagnetically actuated diaphragm, similar to that used within a speaker. In some embodiments a speaker may be used as both a speaker to generate sound and as a portion of a vacuum pump. The speaker diaphragm may act similar to piston 2203 in FIGS. 22 and 23, drawing air in through one port and exhausting air out through another port.

In some embodiments the generation of a vacuum between electronic device 100 (see FIG. 1) and an accessory may remove the need for a retention mechanism on the mating connectors to maintain the devices in a mated and sealed condition. More specifically, in some embodiments a vacuum generated between mated connectors may be used instead of or in addition to some other type of mechanical retention feature to maintain the connectors in a mated position. In one example, instead of a mechanical latch that uses retention features (e.g., see features 365 in FIG. 3), a magnetic latch may be used to maintain the connectors in a mated position and to help maintain a liquid-tight seal. In various embodiments the retention force between the connectors can be in the range of 10 to 15 Newtons while in other embodiments it can be in the range of 7 to 18 Newtons.

Docking Stations and Protective Cases for Electronic Devices

Figure 24:
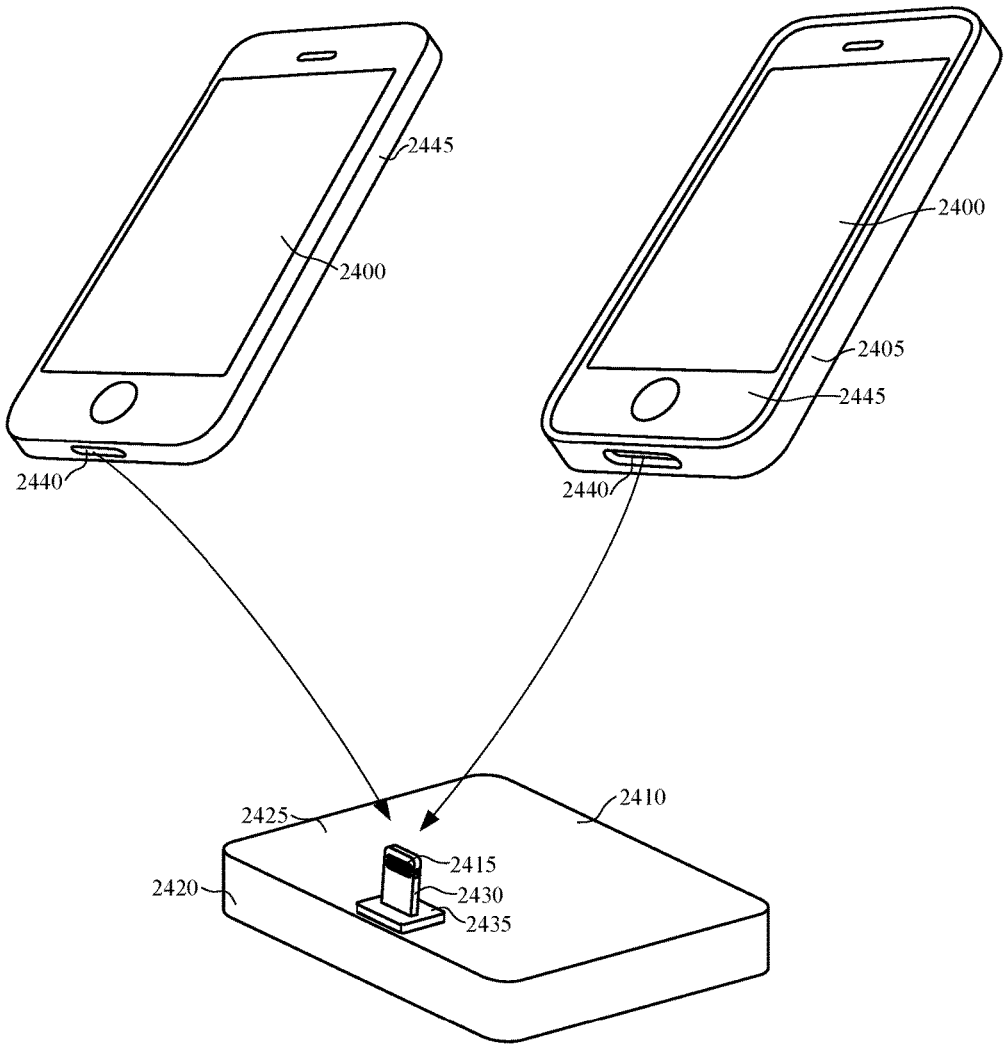
FIG. 24 is an isometric view of a docking station that is configured to form a seal to an electronic device and an electronic device within an environmental protection case according to an embodiment of the disclosure.

FIG. 24 illustrates an electronic device 2400 that may be similar to electronic device 100 in FIG. 1. Electronic device 2400 is illustrated by itself (on the left) and within an environmentally protective case 2405 (on the right). A docking station 2410 is configured to receive either electronic device 2400, or electronic device 2400 with case 2405, and form a liquid-tight seal to the mated device. Docking station 2410 may include any of the features disclosed herein pertaining to accessories illustrated in FIGS. 16-23.

For example, docking station 2410 may include a plug connector 2415 that is similar to plug connector 130 illustrated in FIG. 3. Docking station 2410 may have an exterior housing 2420 having a first face 2425. Plug connector 2415 may have a connector tab 2430 that extends away from first face 2425. A seal 2435 can be similar to seal 1630 and can be positioned around connector tab 2430 and against first face 2425 such that the seal fully surrounds a cross-sectional portion of the connector tab at a region where the connector tab extends out of exterior housing 2420. Seal 2435 can be configured to form a liquid-tight seal to an electronic device when the plug connector is received by the receptacle connector of the electronic device. Seal 2435 is for example only and other configurations of the seal are within the scope of this disclosure.

In another example, docking station 2410 may include speakers (not shown in FIG. 24) for use at a pool side or where they may be exposed to liquid. Seal 2435 may be used to form a seal to electronic device 2400 protecting receptacle connector 2440 from damage from liquid and/or debris. In a further example, docking station 2410 may be used on a boat or other watercraft and may be used to protect electronic device 2400 from damage due to liquid or debris entering receptacle connector 2440. As discussed above, in some embodiments docking station 2410 may be equipped with a vacuum generator to form a vacuum seal between plug connector 2415 and receptacle connector 2440. In other embodiments electronic device 2400 may be equipped with a vacuum generator and docking station 2410 may be passive. More specifically, in one embodiment receptacle connector 2440 may be similar to receptacle connector 1320 illustrated in FIG. 13A, and may have a port 1360 that is coupled by duct 1365 to a vacuum generator disposed within electronic device 2400.

Electronic Devices with Vacuum Generators

Figure 25:
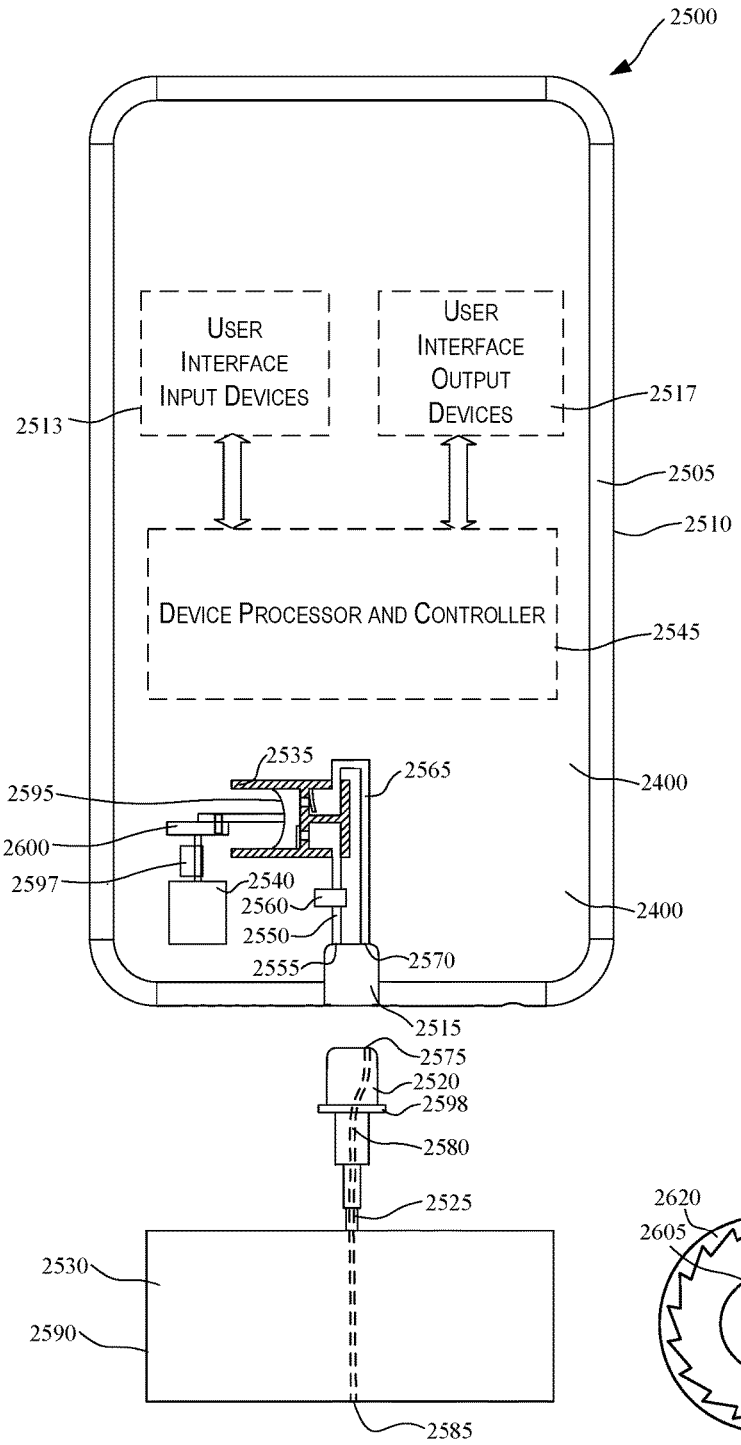
FIG. 25 is simplified view of an electronic device that includes a vacuum generation system according to an embodiment of the disclosure.

Now referring to FIG. 25 an electronic device 2500 is illustrated that may be similar to electronic device 100 in FIG. 1, however electronic device 2500 includes a vacuum generator that can be used to generate a vacuum seal between the electronic device and a mated plug connector of an accessory device, such as one of the accessory devices described above.

Electronic device 2500 can be a tablet computer, a mobile computing device, a smart phone, a cellular telephone, a digital media player, or a variety of other different types of electronic devices. In the embodiments shown in FIG. 25, electronic device 2500 is a smart phone and includes an exterior housing 2505 having an exterior surface 2510, a receptacle connector 2515, a multipurpose button as an input component, a touch screen display as both an input and output component and more microphones and speakers (illustrated in more detail in FIG. 1). In other embodiments, electronic device 2500 can have more, fewer or different components than those illustrated in FIG. 25

Electronic device 2500 can be charged and may communicate through receptacle connector 2515 that is sized and configured to receive plug connector 2520, shown in FIG. 24 as being spaced apart from the receptacle connector in a demated position. In some embodiments receptacle connector 2515 and/or plug connector 2520 may have one or more gaskets or seals that prevent liquid ingression into the receptacle connector and/or electronic device 2500, as described in more detail below. In FIG. 25 plug connector 2520 is at the end of a cable 2525 that is coupled to an accessory 2530.

Vacuum generator 2535 can be disposed within exterior housing 2505 of electronic device 2500 and coupled to an electric motor 2540 that is operated by device processor and controller 2545. Vacuum generator 2535 can be powered by an internal energy source, such as a rechargeable battery (not shown in FIG. 25), and operatively coupled to a vacuum line 2550 that extends between the vacuum generator and a vacuum port 2555 within receptacle connector 2515. Vacuum port 2555 may be used to draw a vacuum within mated receptacle 2515 and plug 2520 connectors, as discussed above. Vacuum line 2550 may be coupled to a pressure sensor 2560 that detects air pressure within the vacuum line and communicates associated data to device processor and controller 2545. In various embodiments electronic device 2500 may operate vacuum generator 2535 until pressure sensor 2560 detects a desired level of vacuum and in response device processor and controller 2545 turns off the vacuum generator.

In some embodiments, pressure sensor 2560 may continuously monitor a vacuum level when the connectors are mated and notify the electronic device when the vacuum level has dropped below a threshold value, indicating that the vacuum seal may be compromised. In some embodiments vacuum line 2550 may also be coupled to a vacuum release valve (not shown in FIG. 25) to break the vacuum seal formed between the connectors so they can be demated, as discussed above. In various embodiments a vacuum release valve may be activated by squeezing a portion of exterior housing 2505 of electronic device 2500.

Vacuum generator 2535 may also have an exhaust line 2565 that discharges air drawn through vacuum port 2555 to the external environment. In the example illustrated in FIG. 25, exhaust line 2565 is routed to an exhaust port 2570 within receptacle connector 2515. Exhaust port 2570 is configured to line up with mating port 2575 on plug connector 2520 and form a sealed connection when the plug connector is mated with the receptacle connector. A discharge line 2580 runs from mating port 2575 through cable 2525, into accessory 2530 and is routed to an exhaust aperture 2585 on housing 2590 of the accessory. Thus, exhaust air is discharged from the vacuum generator within electronic device and is routed through the mated connectors and out of the accessory. In other embodiments exhaust line 2565 can be routed to an exhaust port disposed on exterior housing 2505 of electronic device 2500.

In the embodiment illustrated in FIG. 25 a diaphragm-type vacuum generator 2535 is illustrated. Vacuum generator 2535 is illustrated with diaphragm 2595 at the end of a discharge cycle. Vacuum generator 2535 is driven by electric motor 2540 through clutch 2600. Electric motor 2540 may be controlled by device processor and controller 2545. In some embodiments clutch 2600 may be a unidirectional drive clutch that is illustrated in more detail in plan view in FIG. 26, however other clutch designs may be used and are within the scope of this disclosure.

Figure 26:
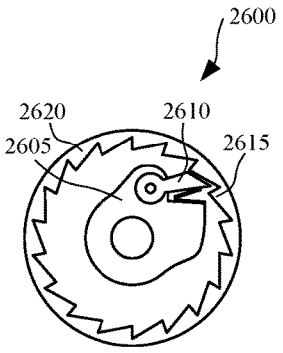
FIG. 26 is an simplified view of a one direction drive clutch that can be used in the electronic device illustrated in FIG. 25.

In some embodiments clutch x enables electric motor 2540 to drive vacuum generator 2535 when the electric motor is operated in a clockwise direction (see FIG. 26). More specifically, electric motor 2540 may be coupled to inner hub 2605. When inner hub 2605 turns in a clockwise direction, cog 2610 engages teeth 2615 on outer hub 2620 and forces it to also turn in a clockwise direction. Outer hub 2620 is coupled to vacuum generator 2535. Conversely, when electric motor 2540 is operated in a counter clockwise direction inner hub 2605 does not engage outer hub 2620 because cog 2610 slips past teeth 2615.

In some embodiments the clockwise, counterclockwise feature may be useful when using a vibration motor to perform independent functions as both a vibration device and a vibration/vacuum pump driver. Thus, in some embodiments a single electric motor 2540 with an offset weight 2597 can be switched between a vibration feedback mode (e.g., to alert a user to an incoming call or text message when electronic device is a smart phone in silent or vibration mode) in which the vacuum pump is not activated (e.g., operated in a counterclockwise direction), and a vacuum mode in which the vacuum pump is activated (e.g., operated in a clockwise direction). Other types of drive mechanisms, motors and clutches can be used and are within the scope of this disclosure. Although vacuum generator 2535 is illustrated as one specific type of generator, other type of generators can be used such as, but not limited to, a squeeze type, a piston type or a speaker diaphragm, as discussed above.

Plug connector 2520 may include a deformable seal 2598 positioned around a perimeter of a base portion of such that when the plug connector is mated with electronic device 2500 a liquid-tight seal is formed between the plug connector and the electronic device. In some embodiments receptacle connector 2515 of electronic device 2500 may have an interior seal as described in FIGS. 13A-14.

To operate vacuum generator 2535 a user may employ one or more user interface input devices 2513 that may include one or more sensors, a keyboard, pointing devices such as a mouse or trackball, a touchpad or touch screen incorporated into a display, a scroll wheel, a click wheel, a dial, a button, a switch, a keypad, audio input devices such as voice recognition systems, microphones, and other types of input devices. In general, use of the term "input device" is intended to include all possible types of devices, sensors and mechanisms for inputting information to electronic device 2500. For example, in an iPhone®, user input devices 2513 may include one or more buttons provided by the iPhone®, a touch screen, and the like. A user may provide input regarding vacuum pump operation and/or vacuum release valve operation using one or more of input devices 2513.

User interface output devices 2517 may include a display subsystem, indicator lights, or non-visual displays such as audio output devices, etc. The display subsystem may be a cathode ray tube (CRT), a flat-panel device such as a liquid crystal display (LCD), a projection device, a touch screen, and the like. In general, use of the term "output device" is intended to include all possible types of devices and mechanisms for outputting information from electronic device 2500. For example, menus and other options for performing functions in accordance with a contactless operating mode may be displayed to the user via an output device. Software (programs, code modules, instructions) that when executed by device processor and controller 2545 provide the functionality described above may be stored in a storage subsystem.

Although embodiments are described and illustrated herein as using one particular electronic connector (for example, plug connector 130 in FIG. 3), embodiments of the disclosure are suitable for use with a multiplicity of electronic connectors. For example, any plug or receptacle connector can be used with embodiments of the invention. As illustrative examples, audio jacks, AC wall plugs, RJ-45's, USB's or any other type of connector can be used without departing from this disclosure. As another example the embodiments disclosed herein are applicable to connector devices such as those used in SIM card trays. In one example a seal may be used to seal the SIM card tray to a housing of the electronic device and a vacuum generator may be used to draw a vacuum within the SIM card enclosure.

Although electronic device 100 (see FIG. 1) is described and illustrated as one particular electronic device, embodiments of the disclosure are suitable for use with a multiplicity of electronic devices. For example, any device that receives or transmits audio, video or data signals can be used with embodiments of the disclosure. In some instances, embodiments of the disclosure are particularly well suited for use with portable electronic media devices because of their potentially small form factor. As used herein, an electronic media device includes any device with at least one electronic component that can be used to present humanperceivable media. Such devices can include, for example, portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, as well as tablet (e.g., Apple's iPad devices), laptop or other mobile computers. Some of these devices can be configured to provide audio, video or other data or sensory output.

For simplicity, various internal components, such as control circuitry, graphics circuitry, bus, memory, storage device and other components of electronic device 100 (see FIG. 1) are not shown in the figures.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. A plug connector comprising:

a body;

an outer shell encasing at least a portion of the body;

a connector tab extending away from the body beyond the outer shell; and a seal positioned at least partially between the outer shell and the connector tab, the seal fully surrounding a cross-sectional portion of the connector tab at a location where the connector tab extends out of the body and wherein the seal further includes a protruding portion that extends towards a distal end of the connector tab.

2. The plug connector of claim 1 wherein the connector tab forms a portion of an axisymmetric connector that can be mated with a receptacle connector in a first orientation and a second orientation, wherein the second orientation is rotated 180 degrees along an axis of symmetry from the first orientation.

3. The plug connector of claim 1 wherein the connector tab includes a first surface having a plurality of external contacts and a second surface opposite the first surface.

4. The plug connector of claim 1 further comprising one or more retention features that secure the plug connector to a corresponding receptacle connector in a mated position.

5. The plug connector of claim 1 wherein the seal is positioned to form a liquid-tight seal to an enclosure of an electronic device when the plug connector is mated to a receptacle connector of the electronic device.

6. The plug connector of claim 1 wherein the seal is formed from a silicone material.

7. The plug connector of claim 1 wherein the seal extends away from the body a distance between 0.25 and 2 millimeters.

8. A plug connector comprising:

a body having a first face;

an outer shell encasing at least a portion of the body;

a connector tab extending from a base portion positioned at the first face to a distal end, the connector tab including a first surface having a plurality of contacts and a second surface opposite the first surface; and a deformable seal positioned around a perimeter of the base portion of the connector tab, the seal including a protruding portion that extends towards a distal end of connector tab forming a step positioned along the first and second surfaces of the connector tab.

9. The plug connector of claim 8 wherein the deformable seal is in direct contact with both the body and the connector tab.

10. The plug connector of claim 8 wherein the deformable seal is positioned at least partially between the outer shell and the connector tab.

11. The plug connector of claim 8 wherein the deformable seal is disposed across a majority of the first face.

12. The plug connector of claim 8 wherein the deformable seal is secured to the body with an adhesive.

13. The plug connector of claim 8 wherein the deformable seal is formed from an elastomeric material having a hardness in a range between 5 and 80 Shore A.

14. The plug connector of claim 8 wherein the deformable seal extends away from the first face a distance between 0.25 and 2 millimeters.

* * * * *